US006080942A

United States Patent [19]

Sasaki

[11] Patent Number: 6,080,942

[45] Date of Patent: Jun. 27, 2000

[54] SWITCH DEVICE

[75] Inventor: Takumi Sasaki, Chiba, Japan

[73] Assignee: Sony Corporation, Tokyo, Japan

[21] Appl. No.: 09/020,215

[22] Filed: Feb. 6, 1998

[30] Foreign Application Priority Data

Feb. 13, 1997 [JP] Japan ..... 9-029392
Feb. 13, 1997 [JP] Japan ..... 9-029393
Feb. 13, 1997 [JP] Japan ..... 9-029394

[51] Int. Cl.[7] ..... H01H 3/00

[52] U.S. Cl. ..... 200/17 R; 200/50.01

[58] Field of Search ..... 200/45 R, 6 A, 200/14, 17 R, 18, 61.27, 61.54, 11 R–11 TW, 565, 50.01

[56] References Cited

U.S. PATENT DOCUMENTS 3,293,381 12/1966 Eitel ..... 200/6 A
3,746,804 7/1973 Gammill ..... 200/18 X
4,273,971 6/1981 Tregurtha ..... 200/61.54 X
5,003,132 3/1991 Lagier ..... 200/61.54 X
5,272,290 12/1993 Suzuki et al. ..... 200/4
5,701,660 12/1997 Javery et al. ..... 200/61.54 X
5,780,795 7/1998 O'Reilly ..... 200/61.54

*Primary Examiner*—J. R. Scott
*Attorney, Agent, or Firm*—Limbach & Limbach L.L.P.

[57] ABSTRACT

A switch device for controlling electronic equipment. The switch device has a number of switch elements for setting operating functions of the electronic equipment and is changed over by a thrusting operation or by a rotating operation. The switch device includes a first operating unit supported reciprocably and rotatably, a first switch unit switched by a reciprocating operation of the first operating unit, a second switch unit switched by a rotating operation of the first operating unit and an intermittent rotating unit for supporting the first operating unit for intermittent rotation. The changeover operation of a large number of switch elements can be realized by a smaller number of operating units to enable size reduction of the device as such.

8 Claims, 18 Drawing Sheets

SWITCH DEVICE

BACKGROUND OF THE INVENTION

1. Field of the Invention

This invention relates to a switch device actuated for switching by a thrusting or rotating operation.

2. Description of Related Art

An electronic equipment, such as an acoustic recording and/or reproducing apparatus, e.g., a disc recording and/or reproducing apparatus, or a map display device, loaded on a vehicle, such as a car, is usually controlled by a switch device, as a remote control device mounted in separation from the electronic equipment.

This switch device, adapted for controlling the electronic equipment, has a number of switch elements for setting the operating modes or functions owned by the electronic equipment. For setting or switching these operating modes or functions, operating units, such as operating buttons, are provided in association with the switch elements.

A first task to be tackled by the present invention is that, if, for setting or switching a large number of operating modes or functions for e.g., the disc recording and/or reproducing apparatus, switch elements are provided in the switch device in association with the different operating modes or functions, and operating units are provided in association with the different switch elements, the switch device itself becomes bulky in size.

The switch elements provided in the above-described switch device are constructed so that a contactor is provided facing a contact so as to be contacted with the contact and is biassed by a spring in a direction away from the contact. The contactor is thrust against the force of thrust exerted by the spring and is separated from the contact on removing the force of thrust. The switch device is provided with an operating member for thrusting the contactor of the switch elements. The operating member is integrally connected to a mating operating member of the switch elements. If a thrusting member is thrust, the contactor is thrust against the bias of the spring for being contacted with the contact for establishing the electrical connection between the contacts for doing electrical switching of the electronic equipments connected to the switch device.

A second problem to be tackled by the present invention is that, since the operating member is connected as one with the contactor of the switch element, and hence the stroke of movement of the operating member depends on the amount of movement of the contactor, the stroke of movement of the operating member cannot be changed freely.

The above-mentioned switch device is constructed so that the main body portion of the switch device is removably mounted on a base block for improving the operability and for assuring burglary-proofness.

A third problem to be tackled by the present invention is that, in a conventional switch device in which the main body portion of the switch device is removably mounted on the base block, the connection terminal provided on a base block is exposed to outside when the main body portion of the switch device is dismounted, so that the foreign matter, such as dust and dirt, becomes attached to the connection terminal portions on dismounting the main body portion of the switch device, thus possibly short-circuiting the terminal plates of the connecting terminals.

SUMMARY OF THE INVENTION

It is therefore an object of the present invention to provide a switch device free of the above-mentioned problems.

For solving the first task of the present invention, there is provided a switch device including a first operating mechanism supported reciprocably and rotatably, a first switch mechanism switched by a reciprocating operation of the first operating mechanism, a second switch mechanism switched by a rotating operation of the first operating mechanism and an intermittent rotating mechanism for supporting the first operating mechanism for intermittent rotation.

For solving the first task of the present invention, there is provided a switch device including a first operating mechanism supported reciprocably and rotatably, a first switch mechanism switched by a reciprocating operation of the first operating mechanism, a second switch mechanism switched by a rotating operation of the first operating mechanism, a second operating mechanism supported for rotation coaxially with the first operating mechanism, a third switch mechanism switched by the rotating operation of the second operating mechanism and a connecting mechanism for interconnecting the first operating mechanism with the second operating mechanism when the first operating mechanism is thrust. The second operating mechanism is interconnected with the first operating mechanism via the connecting mechanism when the first operating mechanism is thrust and rotated, so that the first operating mechanism is rotated in unison with the first operating mechanism.

For solving the second task, the present invention provides a switch device including a switch element changed over by being thrust, a switch thrusting operating member reciprocably supported for thrusting the switch element and first biassing means interposed between the switch element and the switch thrusting operating member for biassing the switch thrusting operating member in a direction away from the switch element.

For solving the third task, the present invention provides a switch device including a main body portion of the switching device having a switch element and switching means for switching the switch element, a base block on which is removably mounted the main body portion of the switching device and which includes a connection terminal portion electrically connected to a connecting portion provided on the main body portion of the switching device and a shutter member mounted on the base block for movement between a first position covering the connection terminal portion and a second position of opening the connection terminal portion. The shutter member is moved in association with the operation of loading/unloading of the main body portion of the switching device on or from the base block.

DESCRIPTION OF PREFERRED EMBODIMENTS

Figure 1:
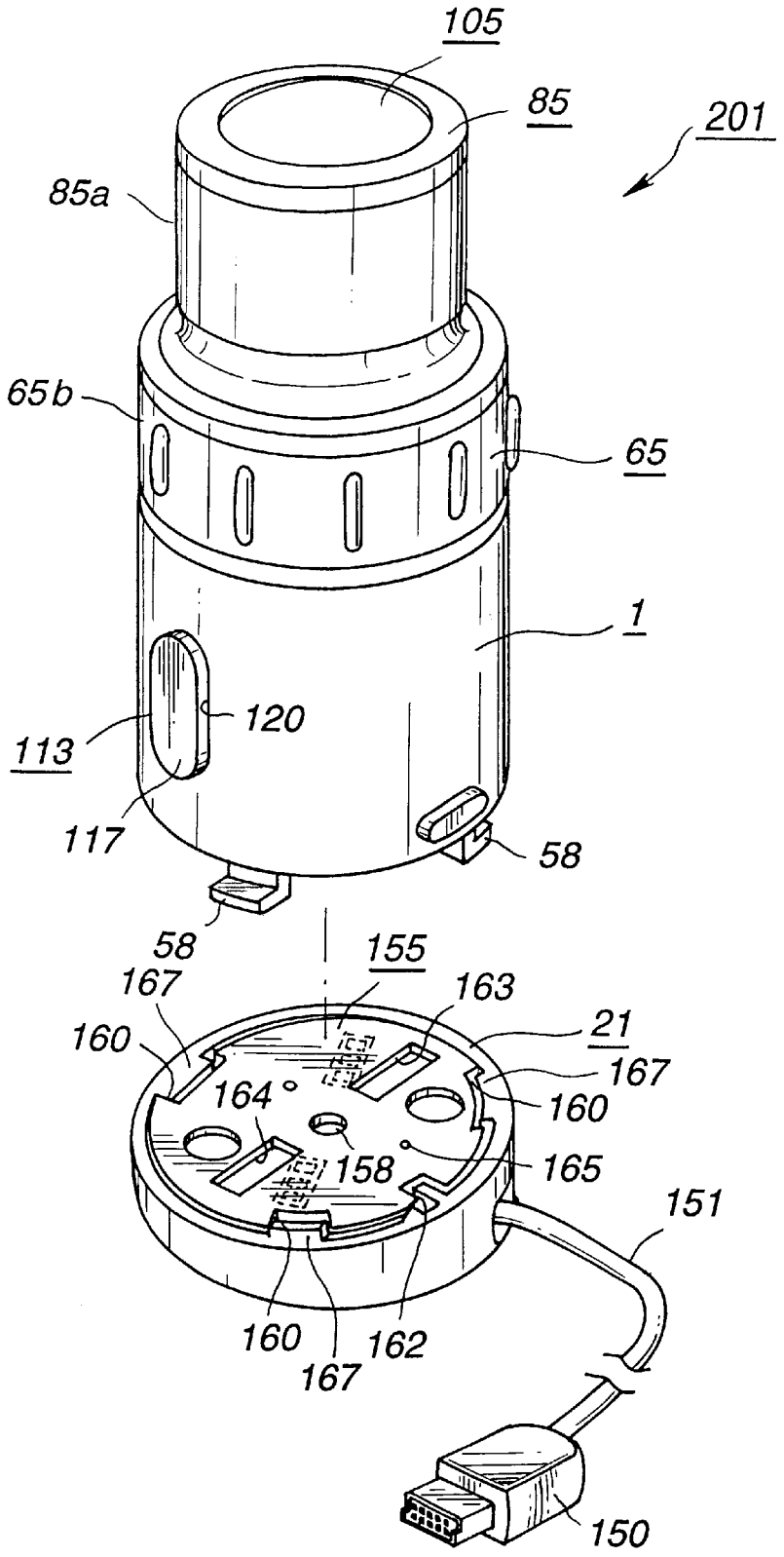
FIG. 1 is a perspective view showing a switch device of the present invention and a base block on which is mounted this switch device.

Referring to the drawings, preferred embodiments of a switch device according to the present invention will be explained in detail.

Referring to FIG. 1, a switch device 201 is removably mounted on a stationary portion, such as a dashboard, of a vehicle, such as a car. The switch device 201 is used for controlling a car-laden disc recording and/or reproducing apparatus or a map display device.

Figure 2:
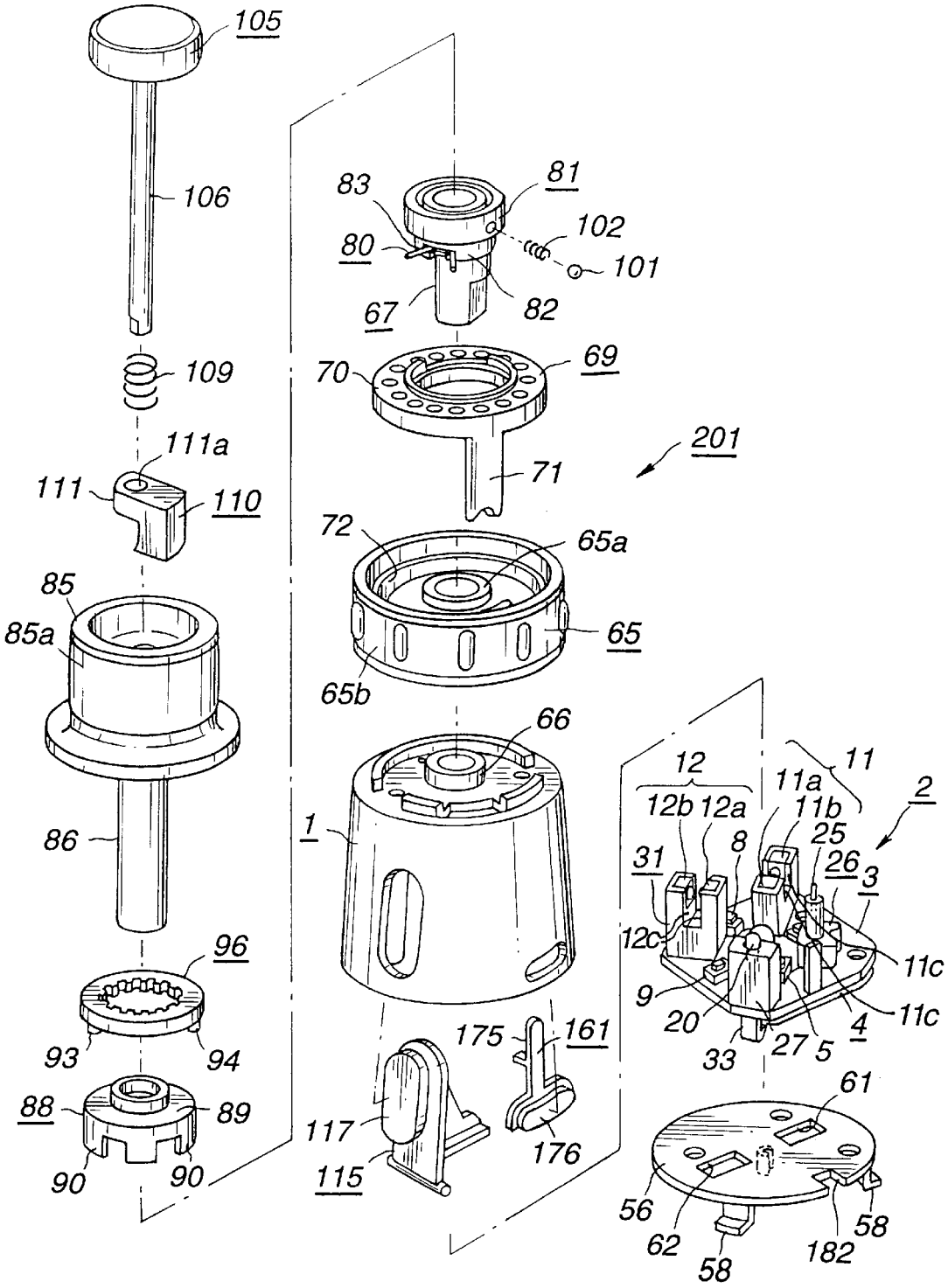
FIG. 2 is an exploded perspective view of the switch device of FIG. 1.

Referring to FIGS. 1 and 2, the switch device 201 includes a cylindrically-shaped main casing member 1, tapering towards its distal end, and a switch element block 2 mounted on the opened bottom side of the main casing member 1.

Figure 3:
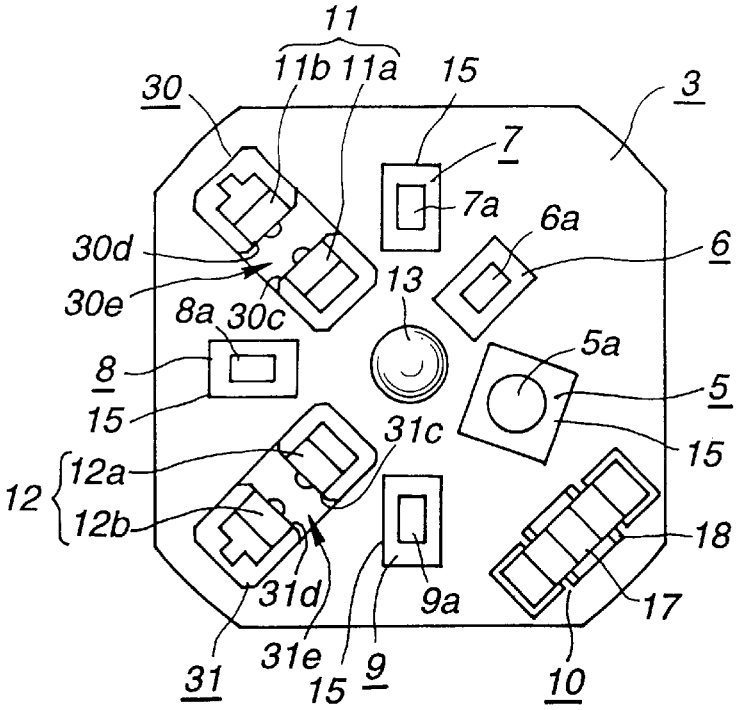
FIG. 3 is a plan view of a printed circuit board constituting a switch element block arranged in a main body portion of a casing of the switch device.

Referring to FIG. 3, the switch element block 2 is comprised of a holder 3, produced by molding synthetic resin, and carrying thereon a printed circuit board 4 having plural switch elements mounted thereon.

In FIG. 3, on one surface of the printed circuit board 4 are mounted first to sixth switch elements 5, 6, 7, 8, 9 and 10, and first and second photocouplers 11, 12. These first to sixth switch elements 5 to 10 and the first and second photocouplers 11, 12 are mounted on the printed circuit board 4 for surrounding a light source 13 which is a light-emitting element, such as LED, mounted at a mid portion of the printed circuit board 4 for specifying the operating state. These first to sixth switch elements 5 to 10 are adapted for being changed over by contactors 5*a*, 6*a*, 7*a*, 8*a* and 9*a* being moved into and out of contact with contacts, not shown, provided within each housing 15. These contactors 5*a* to 9*a* are biassed by spring members provided as biassing means in the housing 15 so as to be protruded out of the housing 15, and are thrust against the force of the spring members for compressing against the contacts provided in each housing 15.

Figure 4:
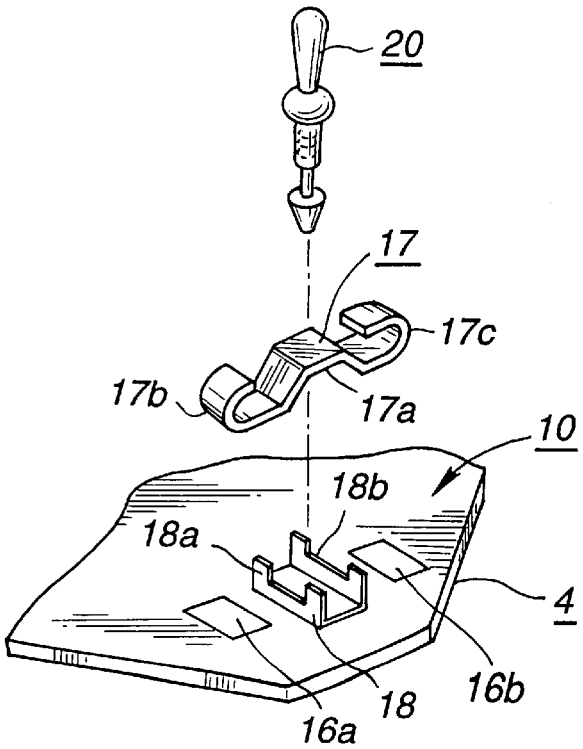
FIG. 4 is an exploded perspective view showing a sixth switch element of the switch element block.

Referring to FIG. 4, the sixth switch element 10 has a pair of contacts 16*a*, 16*b* provided on the printed circuit board 4, and a contact piece 17 formed by an electrically conductive metal plate adapted for being selectively contacted with and moved away from these first and second contacts 16*a*, 16*b*. The contact piece 17 is positioned between first and second contacts 16*a*, 16*b*. The contact piece 17 has its central reentrant portion 17*a* supported by a supporting, which is member 18 constituted by an electrically conductive metal plate mounted on the printed circuit board 4. The contact piece 17 is rotated about the supporting member 18 so that first and second contact portions 17*b*, 17*c* formed by warping its both ends are selectively moved into and out of contact with the first and second contacts 16*a*, 16*b*. Referring to FIG. 4, the supporting member 18 is formed with a pair of supporting pieces 18*a*, 18*b* warped for facing each other. On the distal ends of the supporting pieces 18*a*, 18*b* is arranged the contact piece 17 having the reentrant portion 17*a*. When a rotating member 20 rotatably supported by the holder 3 is rotated to thrust the reentrant portion 17*a*, the contact piece 17 is rotated, with one of the supporting pieces 18*a*, 18*b* as the center of rotation, so that the first and second contact portions 17*b*, 17*c* are selectively contacted and moved away from the first and second contacts 16*a*, 16*b*.

The supporting member 18 is electrically connected to a wiring pattern formed on the printed circuit board 4.

The first and second photocouplers 11, 12 are made up of a pair of light-emitting elements 11*a*, 12*a* and a pair of light-receiving elements 11*b*, 12*b*, mounted on the printed circuit board 4 for facing each other at a pre-set separation from each other.

Figure 5:
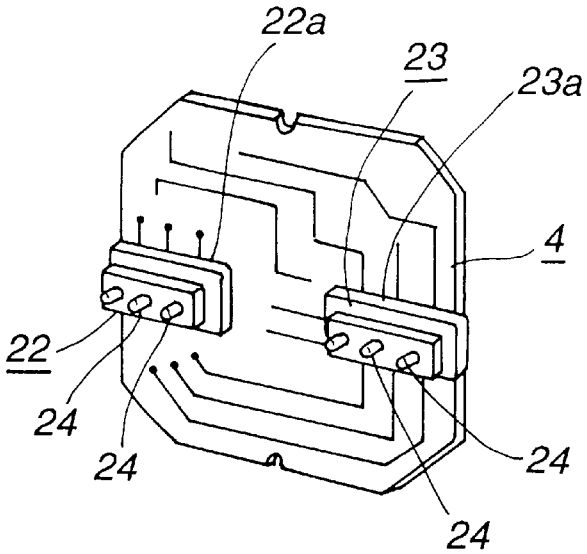
FIG. 5 is a perspective view showing the bottom surface of the printed circuit board constituting the switch element block.

On the opposite surface of the printed circuit board 4 are mounted a pair of connectors 22, 23 for electrically connecting the switch device 201 to connection terminals mounted on the base block 21. These connectors 22, 23 are mounted on main connector members 22*a*, 23*a* so that the connectors appear or disappear from the main connector members 22*a*, 23*a*, respectively, as shown in FIG. 5. Plural contact pins 24 are biassed by spring members, not shown, provided in the main connector members 22*a,* 23*a,* so that the contact pins are protruded from the main connector members 22*a,* 23*a.* When the switch device 201 is mounted on the base block 21, the contact pins 24 are caused to bear against terminal portions provided on the base block 21 for electrically connecting the switch device 201 to the base block 21.

Figure 6:
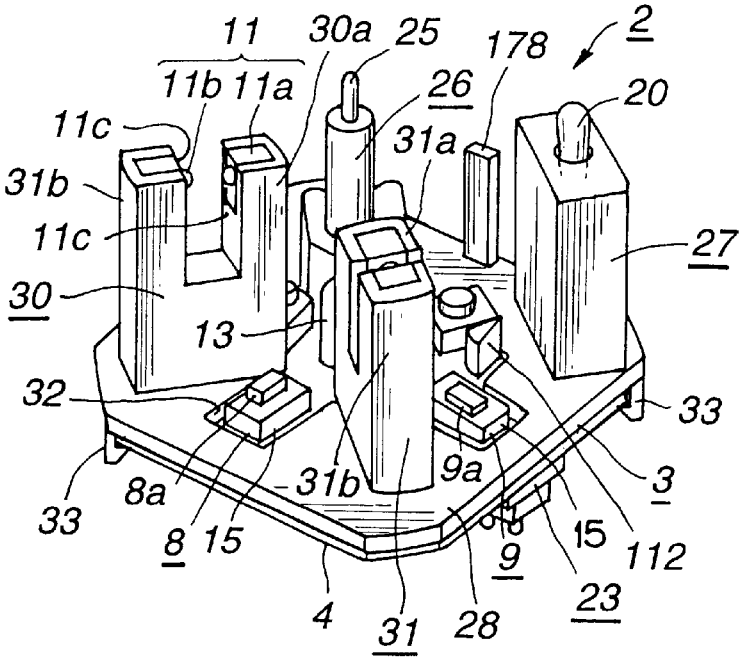
FIG. 6 is a perspective view showing a switch element block arranged in the main body portion of the casing.

In a planar surface of the holder 3, the bottom side of which carries the printed circuit board 4, is housed a second switch element 6, mounted on the printed circuit board 4, as shown in FIG. 6. In the planar surface is also housed a first switch housing unit 26 housing therein a thrusting member 25 adapted for thrusting the second switch element 6 and for constituting a rotary type switch unit along with the second switch element 6. In the planar surface is also housed a second switch housing unit 27 housing the sixth switch element 10 and carrying the rotating member 20 adapted for rotating the sixth switch element 10. The first switch housing unit 26 and the second switch housing unit 27 are mounted upright on a substrate 28 of the holder 3.

Figure 7:
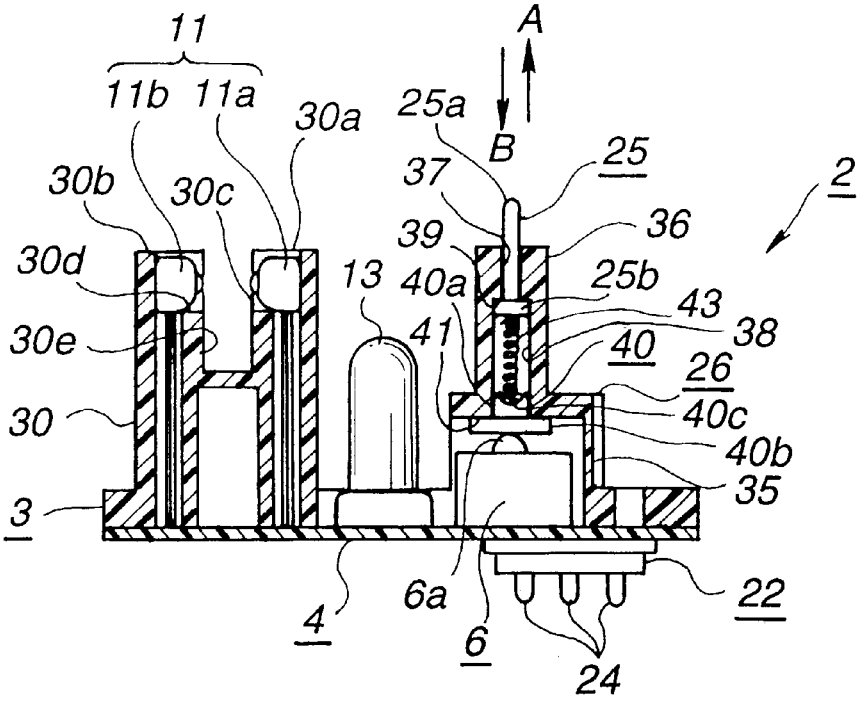
FIG. 7 is a cross-sectional view showing a mechanism of operating a first photocoupler and a second switch element.
Figure 8:
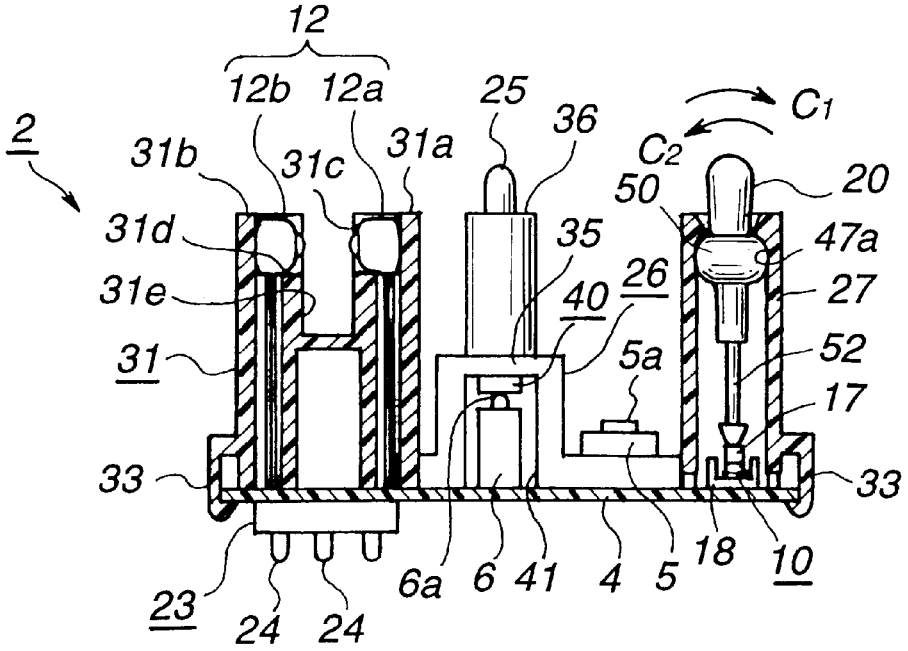
FIG. 8 is a cross-sectional view of a switch element block showing a mechanism for operating a second photocoupler and a sixth switch element.

Referring to FIG. 6, the holder 3 has first and second coupler holders 30, 31 adapted for positioning and holding the light-emitting elements 11*a,* 12*a* and the light-receiving elements 11*b,* 12*b* of the first and second photocouplers 11, 12 mounted on the printed circuit board 4 so that the first and second coupler holders 30, 31 are set upright on the substrate 28. The first and second coupler holders 30, 31 include light emitting element holders 30*a,* 30*b* and light receiving element holders 30*b,* 31*b* adapted for holding the light-emitting elements 11*a,* 12*a* and the light-receiving elements 11*b,* 12*b,* respectively. The light emitting element holders 30*a,* 30*b* and light receiving element holders 30*b,* 31*b* are arranged for facing each other at a pre-set separation therebetween, as shown in FIGS. 3, 7 and 8. The facing surfaces 11*c,* 12*c* carrying the light-emitting elements 11*a,* 12*a* and the light-receiving elements 11*b,* 12*b* are formed with cut-outs for causing these elements to face each other. The separation between the light emitting element holders 30*a,* 30*b* and light receiving element holders 30*b,* 31*b* is designed as shield piece passage portions passed through by shielding pieces, not shown, adapted for shielding the light from the light-emitting elements 11*a,* 12*a* received by the light-receiving elements 11*b,* 12*b.*

In a mid portion of the substrate 28 of the holder 3 is formed an aperture 32 via which the first switch element 5, third switch element 7, fourth switch element 8, fifth switch element 9 and the light source 13 are protruded to the planar surface side. These switch elements and the light source 13 are mounted on the printed circuit board 4 mounted in turn on the bottom surface.

On the opposite side corners of the substrate 28 of the holder 3 are provided a pair of depending retention pawls 33 adapted for retaining the printed circuit board 4 mounted on the bottom surface side of the holder 3.

Figure 9:
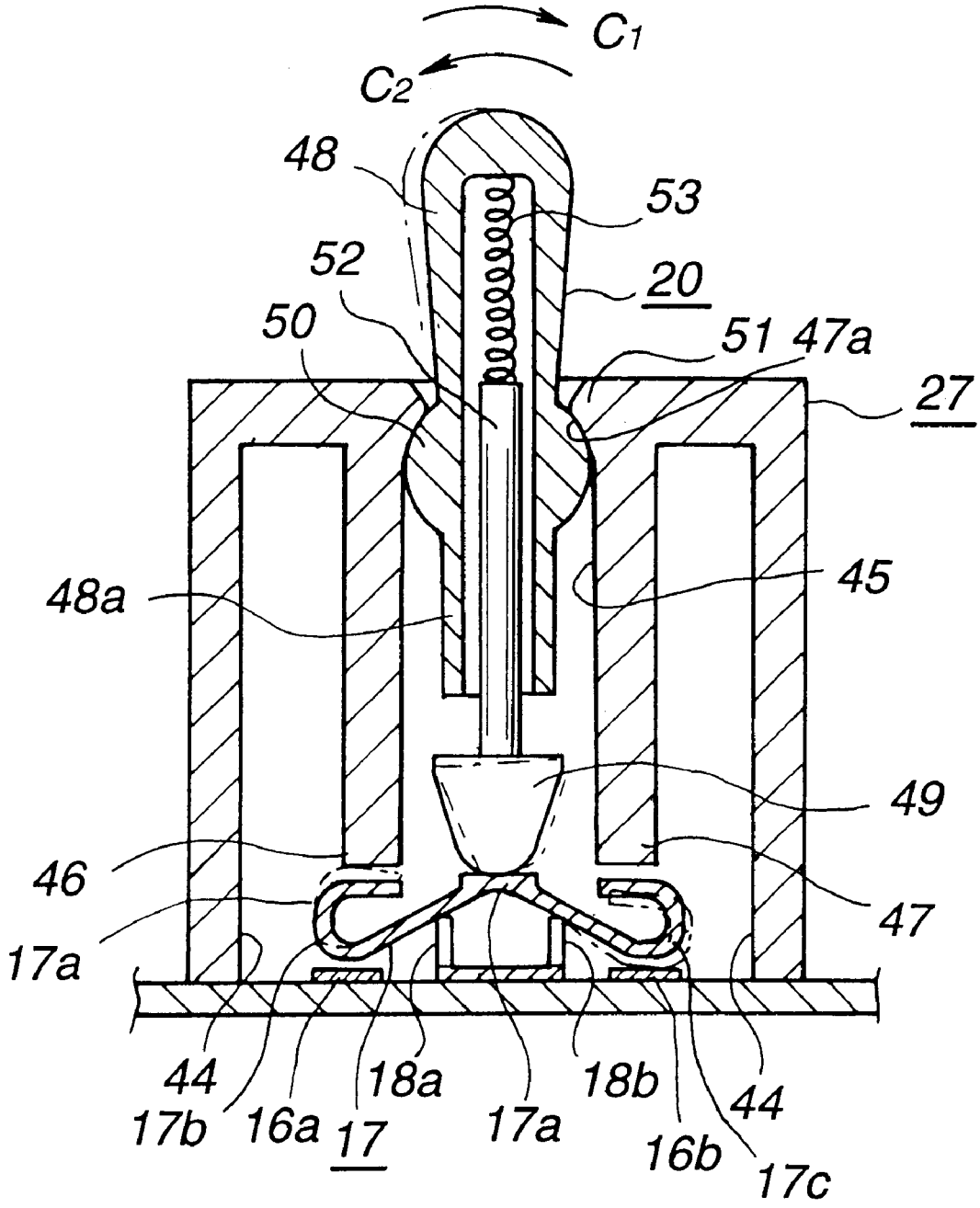
FIG. 9 is a cross-sectional view showing the switching operating state of an eighth switch element.

Referring to FIG. 6, the first switch element 5, third switch element 7, fourth switch element 8, fifth switch element 9 and the light source 13 of the printed circuit board 4 are protruded toward the planar surface side of the substrate 28 via the aperture 32 formed in the substrate 28. The second switch element 6 is housed in the first switch housing member 26, as shown in FIG. 7, while the sixth switch element 10 is housed in the second switch housing unit 27, as shown in FIG. 8. The light-emitting elements 11*a,* 12*a* and the light-receiving elements 11*b,* 12*b,* making up the first and second photocouplers 11, 12, are inserted into the light emitting element holders 30*a,* 30*b* and the light receiving element holders 30*b,* 31*b,* respectively, as shown in FIGS. 8 and 9. The printed circuit board 4 is retained by the retention pawls 33, and is bonded by an adhesive to the bottom surface of the holder 3.

The first switch housing member 26, housing the second switch element 6, is made up of a switch housing 35 for housing the second switch element 6 and a tubular operating member supporting portion 36 protruded to the upper side of the switch housing 35. When the printed circuit board 4 is mounted on the holder 3, the second switch element 6 is housed within the switch housing 35 so that the contactor 6*a* faces the operating member supporting portion 36, as shown in FIG. 7.

In the operating member supporting portion 36 are formed a thrusting member introducing opening 37, passed through by the shaft-shaped thrusting member 25, and a spring housing opening 38 larger in diameter than the thrusting member introducing opening 37 and which is in communication with the thrusting member introducing opening 37. Referring to FIG. 7, the thrusting member 25 is reciprocably mounted in the operating member supporting portion 36 so that the shaft portion 25*a* is introduced into the thrusting member introducing opening 37 with the distal end of the shaft portion 25*a* protruding from the thrusting member introducing opening 37. The thrusting member 25 is mounted on the operating member supporting portion 36 so that, when the shaft portion 25*a* is passed through the thrusting member introducing opening 37, a retainer 25*b* larger in diameter than the shaft portion 25*a* formed on the proximal end of the shaft portion 25*a* is retained by a retention shoulder 39 provided between the thrusting member introducing opening 37 and the spring housing opening 38 for preventing the thrusting member 25 from being detached from the distal end of the thrusting member introducing opening 37.

Towards the proximal end of the spring housing opening 38 is reciprocably mounted a thrusting element 40 adapted for thrusting the contactor 6*a* of the second switch element 6. When the shaft portion 40*a* is passed through the spring housing opening 38, the retainer 40*b* provided on the proximal end of the shaft portion 40*a* is retained by a retention step 41 formed around the proximal end of the spring housing opening 38. The thrusting element 40 is reciprocably mounted on the operating member supporting portion 36.

Within the spring housing opening 38 is mounted a coil spring 43, as a biassing member, between the thrusting member 25 and the thrusting element 40. This coil spring 43 biases the thrusting member 25 in a direction away from the second switch element 6, that is in a direction indicated by arrow A in FIG. 7, while thrusting and biassing the thrusting element 40 into contact with the contactor 6*a* of the second switch element 6. When the thrusting member 25 is thrust in a direction in which the contactor 6*a* of the second switch element 6 is thrust, that is in a direction shown by arrow B in FIG. 7, the coil spring 43 transmits the thrusting force to the contactor 6*a*. The coil spring 43 operates as a connecting member for interconnecting the thrusting member 25 and the second switch element 6.

The thrusting element 40 operates as a spring support for the coil spring 43 and has a reentrant portion 40*c* at the distal end of the shaft portion 40*a* for engaging with the end of the coil spring 43 for preventing its deviation.

The switch mechanism, having the second switch element 6, performs the switching operation by the thrusting member 25 being thrust, against the bias of the coil spring 43, in the direction indicated by arrow B in FIG. 7, via a first operating knob reciprocably mounted on the main casing member 1, as will be explained subsequently.

The coil spring 43 has a spring force which is selected to be smaller than the spring force of the spring member adapted for biassing the contactor 6*a* of the second switch element 6. When the thrusting member 25 is thrust in the direction of arrow B in FIG. 7, against the force of the coil spring 43, the coil spring 43 is compressed. If, after compression of the coil spring 43, a force larger than the biassing force of the spring member biassing the contactor 6*a* is applied to the thrusting member 25, the contactor 6*a* is thrust against the bias of the spring member into contact with the contact for doing the switching of the switch element 6. If the thrust force applied to the thrusting member 25 is removed, the coil spring 43 is reset for moving the thrusting member 25 in the direction of arrow A in FIG. 7. Simultaneously, the spring member is reset for moving the contactor 6*a* away from the associated contact for restoring the second switch element 6 to its initial position.

By interconnecting the thrusting member 25 and the second switch element 6 in this manner via coil spring 43 in-between, the stroke of movement of the thrusting member 25 for doing the switching of the second switch element 6 can be set so as to be sufficiently longer than the thrusting stroke of directly thrusting the contactor 6*a*. By setting the thrusting stroke so as to be longer sufficiently, the operating state of the small-sized second switch element 6, the operating state of the contactor 6*a* of which can be discriminated only with difficulties, can be recognized reliably.

If the load larger than the force of bias of the spring member is applied to the contactor 6*a* of the second switch element 6, the contactor 6*a* is thrust and moved into contact with the associated contact for doing the switching of the switch. On switching the switch, the following relation:

$$\alpha(N)=K(N/mm)\times t(mm)$$

holds between the spring constant K(N/mm) of the coil spring 43 interposed between the thrusting member 25 and the compression stroke t(mm), wherein $\alpha$(N) is the load when the contactor 6*a* is thrust against the bias of the spring member into contact with the associated contact.

When the thrusting member 25 thrusts the coil spring 43 into compression such that the value of K(N/mm)×t(mm) exceeds the value of $\alpha$(N), the contactor 6*a* is thrust against the force of the spring member into contact with the associated contact.

Thus, by suitably modifying the coil spring 43, the stroke of movement of the thrusting member 25 is varied, thus enabling the operating feeling of the thrusting member 25 to be set to an optional value. That is, if the coil spring 43 has a small value of the spring constant K(N/mm), the compression stroke t(mm) needs to be increased, so that the movement stroke of the thrusting member 25 is selected to be larger. Conversely, if the coil spring 43 has a large value of the spring constant K(N/mm), the compression stroke t(mm) needs to be decreased, so that the movement stroke of the thrusting member 25 is selected to be smaller.

By suitably selecting the spring constant K(N/mm) and the compression stroke t(mm) of the coil spring 43 interposed between the second switch element 6 and the thrusting member 25, the movement stroke of the thrusting member 25 can be arbitrarily set for the same thrusting type switch unit.

Although the thrusting element 40 is interposed between the coil spring 43 and the contactor 6*a*, the contactor 6*a* may also be directly acted upon by the coil spring 43.

Referring to FIGS. 6, 8 and 9, a second switch housing unit 27 has a switch housing portion 44 housing the sixth switch element 10 and a rotating member actuating portion 45 for supporting the rotating member 20 adapted for rotating the contact piece 17. When the printed circuit board 4 is mounted on the holder 3, contact piece 17 is adapted for being housed in the switch housing portion 44, as shown in FIGS. 8 and 9. Referring to FIG. 9, the contact piece 17 is arranged in the switch housing portion 44 for rotation about a pair of supporting pieces 18*a*, 18*b*, so that, since a pair of supporting protrusions 46, 47 provided in the switch housing 44 are arranged facing the proximity of both sides of the reentrant portion 17*a* of the contact piece 17 supported by the supporting pieces 18*a*, 18*b*, as shown in FIG. 9, the contact piece 17 is prevented from being detached from the supporting pieces 18*a*, 18*b*, the contact piece 17 being then rotatable about one of the supporting pieces 18*a*, 18*b* as the center of rotation.

The rotating member actuating portion 45 has a central through-hole 47*a* for supporting the rotating member 20 inserted into and retained by the through-hole 47*a*. The rotating member 20 includes a rotary arm 48 and a thrusting element 49 of synthetic resin reciprocably supported by the distal end of the rotary arm 48. This rotary arm has an intermediate swollen-out portion 50 having an arcuate peripheral portion. When the rotary arm is passed through the through-hole 47*a*, the swollen-out portion 50 is carried by the inner peripheral surface of the through-hole 47*a* so that the rotary arm 48 is supported for rotation in a direction indicated by arrow C1 and in a direction indicated by arrow C2 in FIG. 9, perpendicular to the axial direction, about the swollen-out portion 50 as the center of rotation.

The thrusting element 49 is spindle-shaped, with its distal end formed as an arcuate surface, and is mounted on the distal end of a supporting shaft 52. The thrusting element 49 has its supporting shaft 52 passed through a through-hole 48*a* formed in the rotary arm 48 so as to be reciprocably supported by the rotary arm 48. The thrusting element 49 is biassed in a direction of being protruded from the distal end of the rotary arm 48 by a coil spring 53 arranged in the through-hole 48*a*.

By the printed circuit board 4 being mounted on the bottom surface of the holder 3, the rotating member 20 is rotatably supported with the thrusting element 49 kept in pressure contact with the contact piece 17. This rotating member 20 is rotated by a second operating knob rotatably mounted on the main casing member 1, as indicated in directions shown by arrows C1 and C2, as will be explained subsequently. When the rotating member 20 is rotated in the directions shown by arrows C1 and C2 in FIG. 9, the thrusting direction of the contact piece 17 by the thrusting element 49, biassed by the coil spring 53, is displaced. The contact piece 17 is rotated about one of the supporting pieces 18*a*, 18*b* as the center of rotation, for selectively moving first and second contact portions 17*b*, 17*c* into and out of contact with first and second contacts 16*a*, 16*b* for doing the change-over operation of the sixth switch element 10.

The switch element block 2, having the printed circuit board 4 mounted on the holder 3, is loaded in the main casing member 1 via an opening 54 formed in the bottom surface of the main casing member 1. The switch element block 2 causes the substrate 28 making up the holder 3 retained by a retention step 56 provided in the main casing member 1 for being set in position in the direction of height relative to the main casing member 1. The switch element block 2 loaded in the main casing member 1 is secured to the main casing member 1 by a set screw 57 threaded to the main casing member 1 along with a mounting plate 56 adapted for closing the opening 54 formed in the bottom of the main casing member 1.

The mounting plate 56 is used for mounting the switch device 201 on the base block 21, and includes plural mating engagement pawls 58 operating as mating engagement means engaged with plural engagement pieces 167 provided as first engagement means on the base block 21. The mating engagement pawls 58 are mounted for depending on the outer rim side, as shown in FIG. 11. In the present embodiment, there are provided three such mating engagement pawls 58. At a mid portion of the mounting plate 56 is protuberantly formed an engagement pin 59 controlling the mounting direction of the switch device 201 when mounting the switch device 201 on the base block 21, as shown in FIG. 11. The switch device 201 has its mounting position relative to the base block 21 controlled by having an axially extending engagement groove 60 formed in the engagement pin 59 and by having this engagement groove 60 engaged by engagement lugs, not shown, on the base block 21. The mounting plate 56 is formed with a pair of cut-outs 61, 62 via which are protruded contact pins 24 of the connectors 22, 23 mounted on the bottom surface of the printed circuit board 4. A thread passage portion 62*a* passed through by a set screw 57 adapted for securing the mounting plate 56 to the main casing member 1 is formed for being protruded towards the printed circuit board 4 and, when the mounting plate 56 is secured to the main casing member 1, the thread passage portion 62*a* is abutted against the printed circuit board 4 for defining a housing space for the connectors 22, 23 between the mounting plate 56 and the printed circuit board 4. Thus, only the contact pins 24 are projected on the bottom surface of the switch device 201, as shown in FIGS. 10 and 11.

Figure 10:
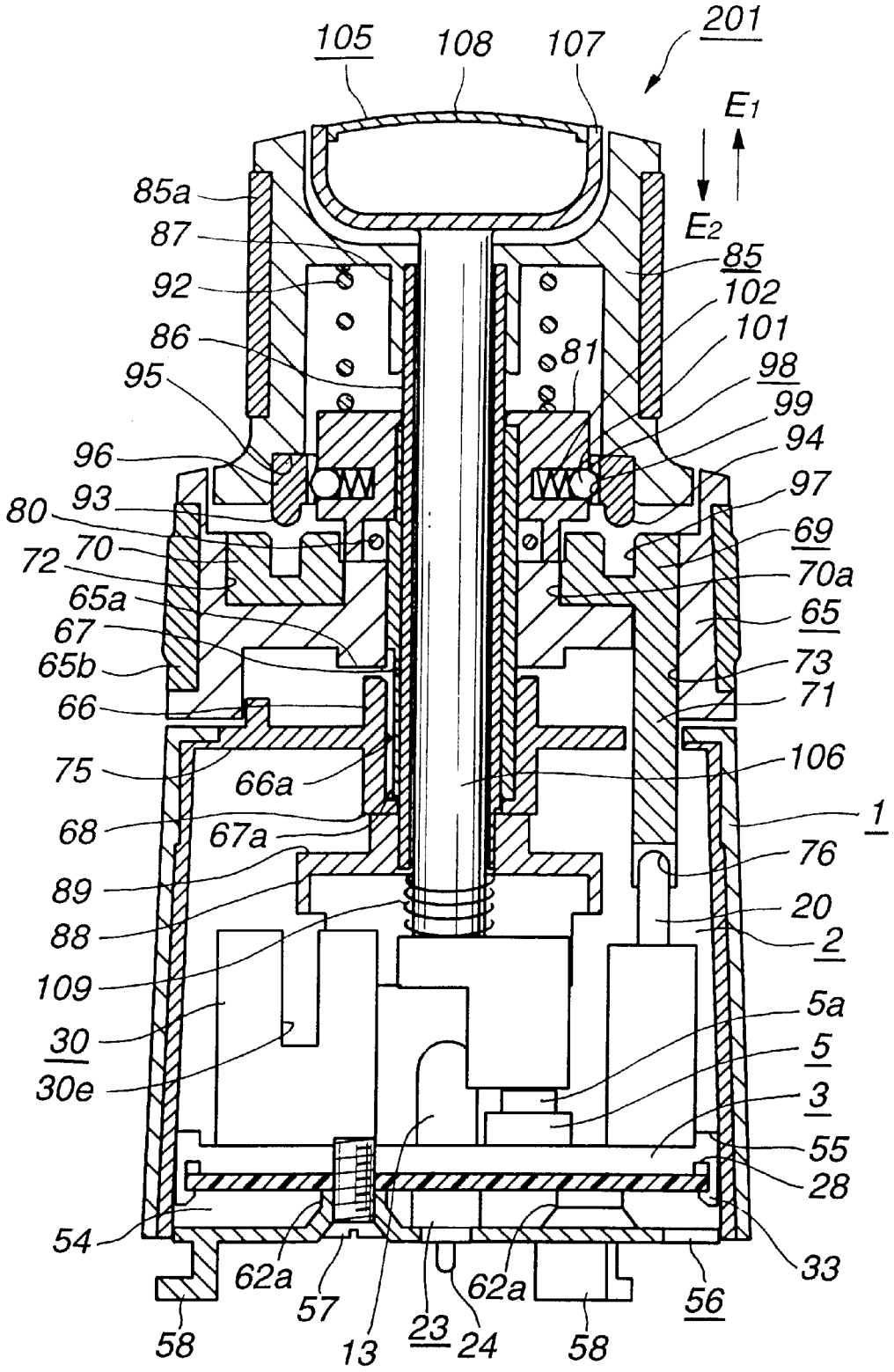
FIG. 10 is a longitudinal cross-sectional view of a switch device according to the present invention.
Figure 11:
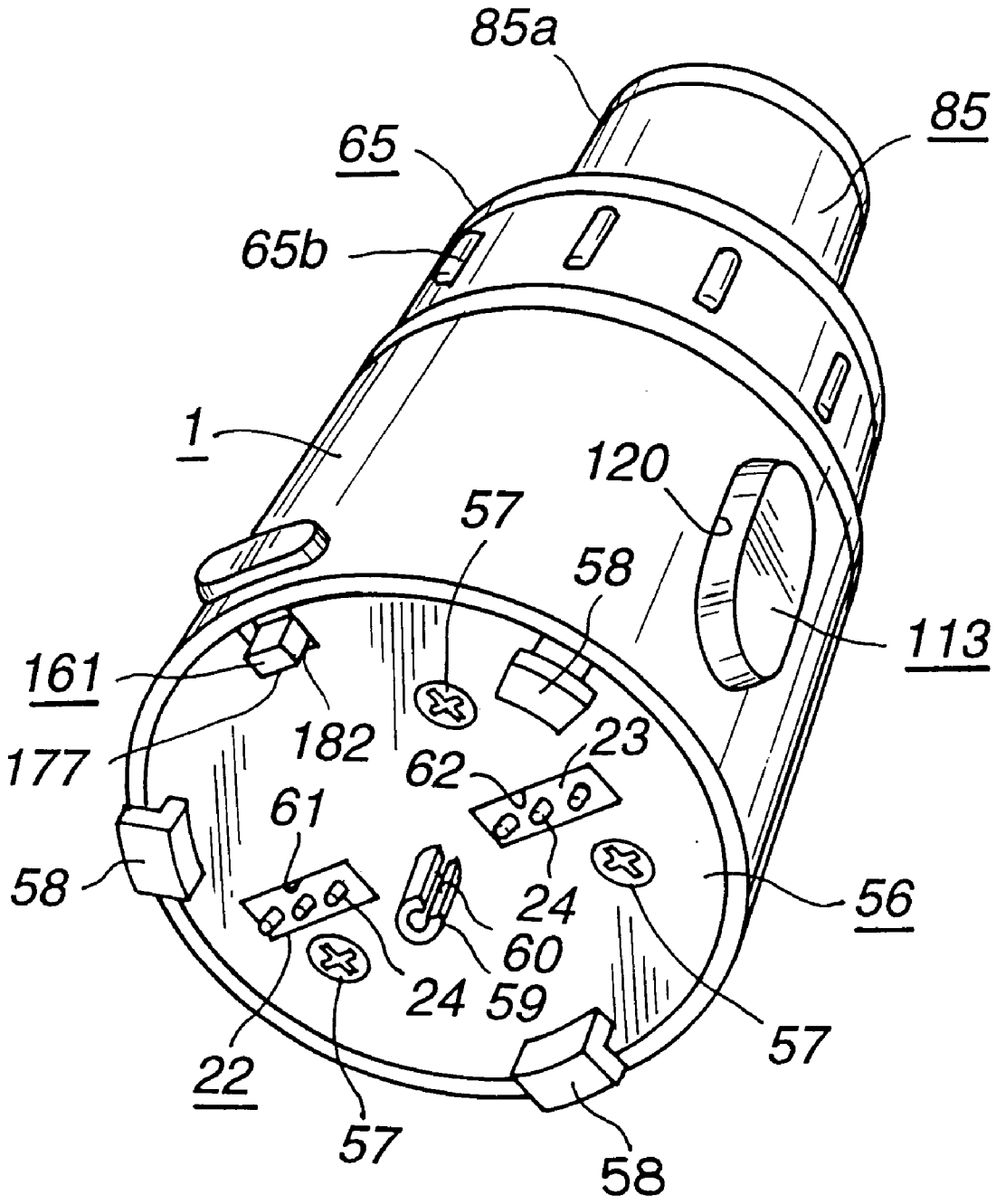
FIG. 11 is a perspective view showing the bottom side of the switch device according to the present invention.

On the upper end of the main casing member 1, carrying the switch element block 2, there is mounted a disc-shaped second operating knob 65 adapted for rotating the rotating member 20 of the sixth switch element 10, as shown in FIGS. 1, 2 and 10. This second operating knob 65 is rotatably supported by a supporting tube 67 by having its mid tubular inserting portion 65*a* passed through the tubular supporting tube 67 fitted in a tubular portion 66 at an upper mid portion of the main casing member 1.

The outer periphery of the second operating knob 65 is encircled by a ring member 65*b* of rubber for facilitating holding thereof during operation.

Figure 12:
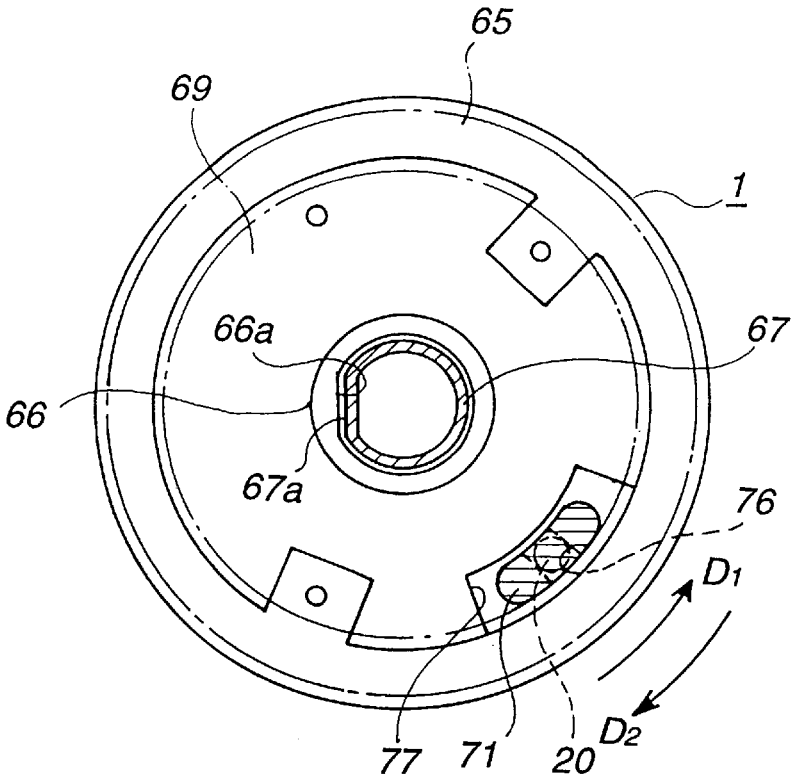
FIG. 12 is a cross-sectional view showing the state in which a second operating knob is provided on the main body portion of the casing.

The inner peripheral surface of the tubular portion 66 and the outer peripheral surface on the distal end of the supporting tube 67 are formed with planar surfaces 66*a*, 67*a*, respectively, for providing D-shaped cross-sections, as shown in FIG. 12. The supporting tube 67 is mounted as-one on the main casing member 1 by being fitted on the tubular portion 66 with the planar surface 67*a* in register with the planar surface 66*a* of the tubular portion 66.

On the lower end of the tubular portion 66 is protuberantly formed a fitting position controlling piece 68, extending towards the inner rim, as shown in FIG. 10. The supporting tube 67 has its fitting position relative to the main casing member 1 controlled by being fitted so that its distal end compresses against the fitting position controlling piece 68.

The second operating knob 65, rotatably mounted on the tubular portion 66, carries a rotation actuating member 69 adapted for rotating the rotating member 20 of the sixth switch element 10, as shown in FIGS. 2 and 10. The rotation actuating member 69 includes a disc-shaped portion 70 and a connection lever 71 formed for extending from the outer rim of the lower surface of the disc-shaped portion 70, as shown in FIG. 2. The rotation actuating member 69 is mounted on the second operating knob 65 by having the disc-shaped portion 70 fitted in a fitting recess 72 formed in the upper end face of the second operating knob 65 and by having a connection lever 71 inserted through a through-hole 73 formed in the bottom surface of the fitting recess 72, as shown in FIGS. 2 and 10. The rotation actuating member 69 is supported for rotation about the supporting tube 67 as-one with the second operating knob 65 by having a center hole 70*a* in the disc-shaped portion 70 passed through by an inserting portion 65*a* of the second operating knob 65.

The connection lever 71 of the rotation actuating member 69 is inserted into the inside of the main casing member 1 via a rotation controlling opening 77 formed in an upper end wall section 75 of the main casing member 1, as shown in FIGS. 10 and 12, and is connected to the rotating member 20 by having a recessed end connecting portion 76 fitted on the distal end of the rotating member 20 of the sixth switch element 10. By connecting the connection lever 71 to the rotating member 20 in this manner, the second operating knob 65 is turned for rotating the rotating member 20 in the directions indicated by arrows C1 and C2 in FIGS. C1 and C2.

The rotation controlling opening 77, formed in the main casing member 1, is arcuately-shaped with a length sufficient to permit rotation of the connection lever 71 to permit the change-over operation of the sixth switch element 10 to permit rotation of the rotating member 20, as shown in FIG. 12. The second operating knob 65 is rotated in the directions of arrows Disc player 1 and D2 of FIG. 12, about the supporting tube 67 as the center of rotation, within the range of rotation controlling opening 77.

The second operating knob 65 is rotationally biassed by a torsion coil spring 80 to a position of holding the rotating member 20 at a neutral position in the absence of the rotating operation. In a non-operating state, the second operating knob 65 is rotationally biassed at a neutral position in which the contact piece 17 is not rotated by the rotating member 20 and in which the first and second contact portions 17*b*, 17*c* of the contact piece 17 are not contacted with the first second contact 16*a* nor with the second contact 16*b*.

Figure 13:
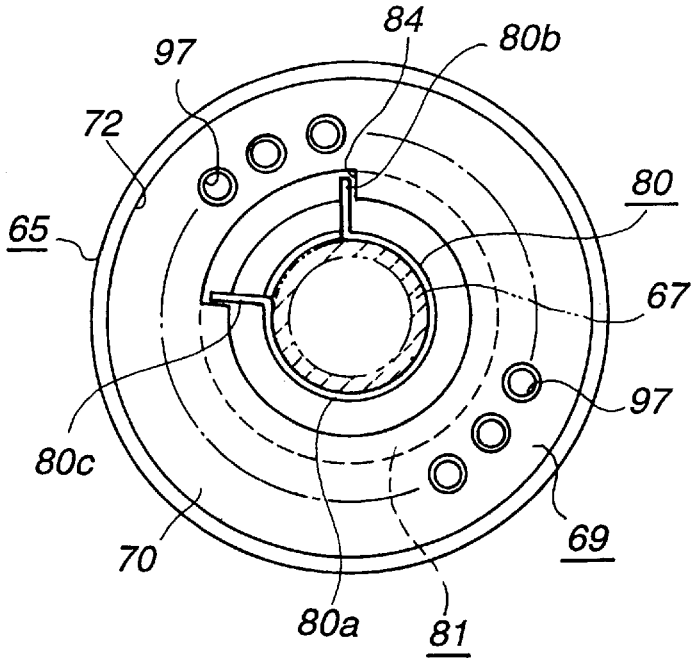
FIG. 13 is a cross-sectional view showing the mounting state of a torsion coil spring holding the second operating knob at a neutral position.

A torsion coil spring 80 rotationally biassing the second operating knob 65 to a neutral position is mounted via a spring holder 81 mounted on the proximal end of the supporting tube 67. The proximal end of the spring holder 81 is fitted with a tubular-shaped spring retainer 82. The torsion coil spring 80 is placed around the supporting tube 67 so that its coil part is contracted and housed within the spring retainer 82. The torsion coil spring 80 is maintained in its contracted state by both end arm portions 80*b*, 80*c* extending from the coil part 80*a* engaged with engagement grooves 83 formed in the peripheral wall of the spring retainer 82, as shown in FIGS. 12 and 13. The torsion coil spring 80 is held by the spring retainer 82 in a biassed position of opening the end arm portions 80*b*, 80*c*. The end arm portions 80*b*, 80*c* of the torsion coil spring 80 are protruded from the engagement grooves 83 outwardly of the spring retainer 82 so as to be engaged with both sides of a spring retainer groove 84 formed on the inner rim of the rotation actuating member 69. The rotation actuating member 69, in which the paired end arm portions 80*b*, 80*c* of the torsion coil spring 80, held by the spring holder 81 in the state of being biassed in the direction of opening the end arm portions 80*b*, 80*c*, are retained on both sides of the spring retainer groove 84, is kept at a neutral position of placing the rotating member 20 at the inoperative position under the bias of the torsion coil spring 80. The second operating knob 65, carrying the rotation actuating member 69 for rotation in unison therewith, is also placed at the neutral position.

If the second operating knob 65 is turned in the directions of arrows Disc player 1 or D2 in FIG. 12, about the supporting tube 67 as the center of rotation, the rotation actuating member 69 is also rotated in the same direction, against the bias of the torsion coil spring 80. This causes rotation of the rotation actuating member 69 in the same direction against the bias of the torsion coil spring 80, while causing rotation of the contact piece 17 about one of the paired supporting pieces 18*a,* 18*b* as the center of rotation, so that the first and second contact portions 17*b,* 17*c* will be selectively contacted with or separated from the first and second contacts 16*a,* 16*b,* for doing the switching of the sixth switch element 10.

The rotation actuating member 69 may also be provided as-one with the second operating knob 65, with the connecting lever 71 being formed as one with the second operating knob 65.

The main casing member 1 is provided with a first operating knob 85 constituting the first operating mechanism for switching the second switch element 6. The first operating knob 85 is shaped as a bottomed cylinder and has a tubular supporting shaft 86 at its mid portion, as shown in FIGS. 2 and 10. The supporting shaft 86 has its proximal end fitted in a fitting tubular portion 86 provided at the center of the first operating knob 85 and is integrally mounted on the first operating knob 85. The outer periphery of the first operating knob 85 is wrapped by a rubber ring member 85*a* for facilitating gripping during actuation.

The first operating knob 85, constituting the first operating mechanism, is mounted on the main casing member 1 with the supporting shaft 86 being passed through the tubular supporting tube 67 mounted on the tubular portion 66 of the main casing member 1, as shown in FIG. 10. The first operating knob 85 is supported by the main casing member 1 for rotation about and for reciprocation along the axis of the supporting shaft 86.

On the distal end of the supporting shaft 86 of the first operating knob 85 is mounted a switching actuator 88 for switching the operating states of the second switch element 6 and for switching the outputs of the first and second photocouplers 11, 12. These first and second photocouplers 11, 12 and the switching actuator 88 make up a rotary type switch mechanism.

Figure 14:
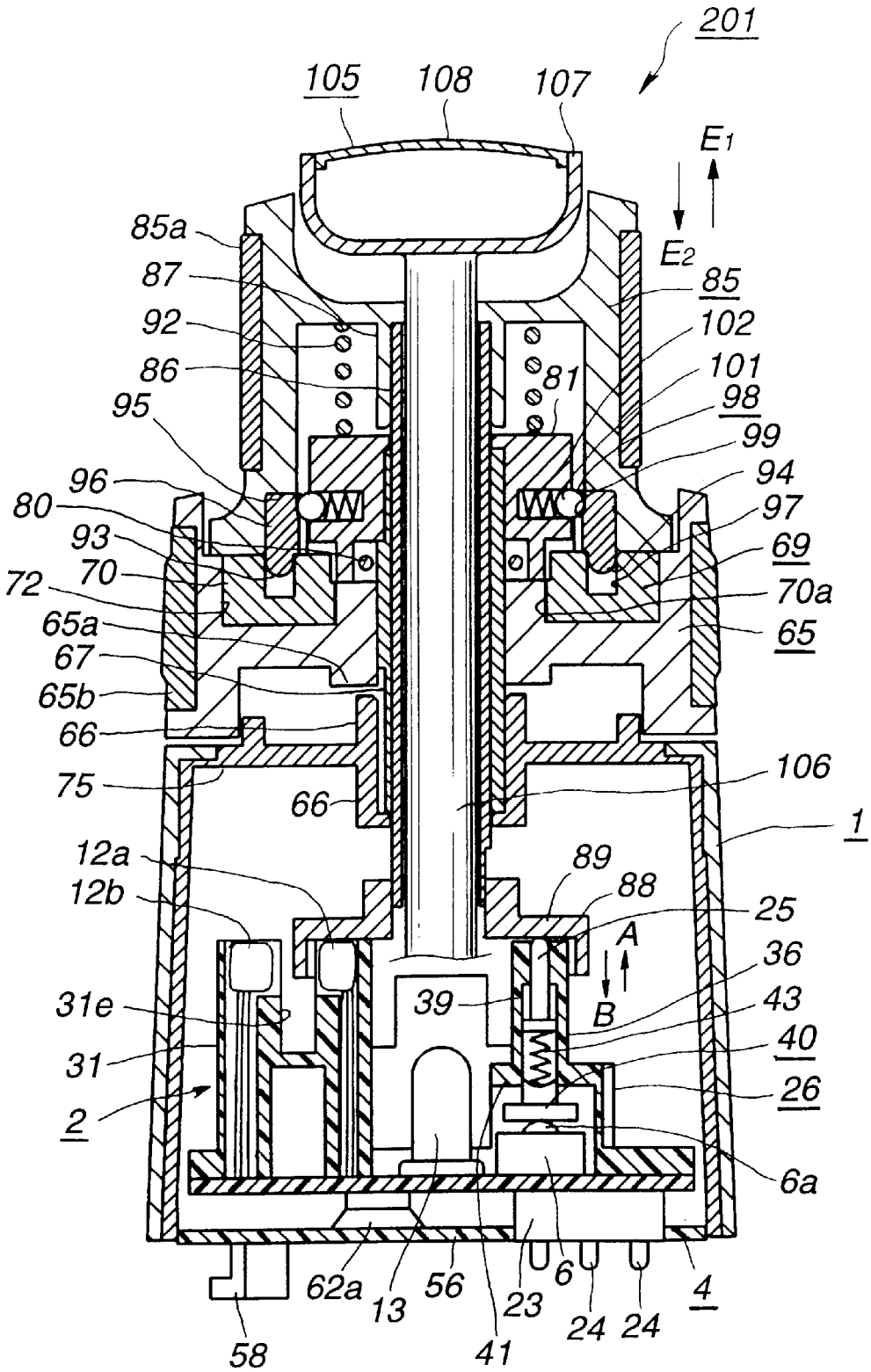
FIG. 14 is a cross-sectional view showing the state in which the second switch element is thrust by the first operating knob.

Referring to FIGS. 2 and 10, the switching actuator 88 includes a disc-shaped thrusting plate 89 for thrusting the thrusting member 25 of the second switch element 6 and plural interrupting pieces 90 for interrupting the light emitted by the first and second light-emitting elements 11*a,* 12*a* of the first and second photocouplers 11, 12 formed as-one with the peripheral portion of the thrusting plate 89 for depending therefrom and is formed substantially cylindrically. The switching actuator 88 is mounted in position by having the distal end of the supporting shaft 86 having the D-shaped cross-section fitted in a fitting opening 91 formed at the center of the thrusting plate 89. The switching actuator 88 is mounted on the supporting shaft 86 of the first operating knob 85 with the thrusting plate 89 facing the thrusting member 25 of the second switch element 6 and with the interrupting pieces 90 facing the gap between the light-emitting elements 11*a,* 12*a* and the light-receiving elements 11*b,* 12*b* of the first and second photocouplers 11, 12, as shown in FIG. 14.

The switching actuator 88, mounted on the supporting shaft 86, has its upper end portion abutted against the lower end of the tubular portion 66 of the main casing member 1 for preventing accidental removal of the first operating knob 85 form the main casing member 1.

The first operating knob 85 is biassed by a compression coil spring 92, as a biassing member interposed between an upper wall section 85*b* of the first operating knob 85 and the spring holder 81, in a direction in which the switching actuator 88 is moved away from the thrusting member 25 of the second switch element 6, as indicated by arrow E1 in FIG. 10. When the first operating knob 85 is thrust in the direction of arrow E2 in FIG. 10, against the bias of the compression coil spring 92, the thrusting plate 89 of the switching actuator 88 is caused to bear against the thrusting member 25 of the second switch element 6. If, after the switching actuator 88 is caused to bear against the thrusting member 25, the first operating knob 85 is thrust further, the coil spring 43, interconnecting the thrusting member 25 and the contactor 6*a* of the second switch element 6 is compressed. If the force larger than the biassing force of the spring member larger than the spring member biassing the contactor 6a is applied to the thrusting member 25, the contactor 6*a* is thrust in the direction of arrow B in FIG. 14, against the bias of the spring member, into contact with the associated contact for doing the switching of the second switch element 6.

Since the first operating knob 85 is supported rotatably in the main casing member 1, it is rotated when the second switch element 6 is thrust in the switching direction. Thus, there is a fear that the thrusting member 25 cannot be thrust in stability. On the lower end face of the first operating knob 85 facing the main casing member 1, there are provided a pair of guide protrusions 93, 94 which perform a thrusting operation axially of the supporting shaft 86 reliably without rotation when the first operating knob 85 is thrust along the axis of the supporting shaft 86 as indicated by arrow E2 in FIG. 10 against the force of the compression coil spring 92. These guide protrusions 93, 94 are protuberantly formed on a ring-shaped member 96 fitted as-one in a fitting recess 95 formed at the lower end of the first operating knob 85. On the major surface of the rotation actuating member 69 mounted on the second operating knob 69 faced by the ring-shaped member 96 are formed plural guide holes 97 in a ring-shaped pattern so as to be engaged by the protrusions 93, 94, as shown in FIGS. 2 and 13.

When the guide protrusions 93, 94 are in the non-operative state, under the force of the compression coil spring 92, with the first operating knob 85 being not thrust, as shown in FIG. 10, the guide protrusions 93, 94 are in the spaced-apart condition, without engaging with the guide holes 97, such that only the first operating knob 85 is in the rotatable state.

If the first operating knob 85 is thrust in a direction indicated by arrow E2 in FIG. 10, the guide protrusions 93, 94 are engaged in a pair of the guide holes 97. If the guide protrusions 93, 94 are engaged in the guide holes 97, the second operating knob 69, provided with the guide holes 97, is biassed by a torsion coil spring 80 towards the neutral position. Thus, the first operating knob 85 having the guide protrusions 93, 94 engaged in the guide holes 97 is limited in its free rotation. The guide holes 97 and the guide protrusions 93, 94, engaged with each other, make up a rotation limiting mechanism for limiting the rotation of the first operating knob 85. The first operating knob 85 is further thrust in the direction indicated by arrow E2 in FIG. 10. This causes the guide protrusions 93, 94 to be linearly displaced along the axis of the supporting shaft 86 to cause the first operating knob 85 to thrust the thrusting member 25 of the second switch element 6, as shown in FIG. 14. With the guide protrusions 93, 94 thus engaging with the guide holes 97, the first operating knob 85 can reliably be moved linearly to effect thrusting of the thrusting member 25 of the second switch element 6 in a stable state to effect reliable switching of the operating state of the second switch element 6.

With the guide protrusions 93, 94 of the first operating knob 85 engaging with the guide holes 97, the guide protrusions 93, 94 can be engaged with the guide holes 97 by a small relative rotation due to provision of a large number of the guide holes 97.

With the guide protrusions 93, 94 of the first operating knob 85 not engaging with the guide holes 97, the guide protrusions 93, 94 are abutted against the major surface of the rotation actuating member 69 for limiting further thrusting by way of limiting the thrusting of the second switch element 6 against the thrusting member 25 of the second switch element 6. Since the switching operation for the second switch element 6 is performed when the first operating knob 85 performs correct linear movement, malfunctions may be inhibited reliably.

If the first operating knob 85 is thrust such that the guide protrusions 93, 94 are engaged in the guide holes 97, the first operating knob 85 is interconnected with the second operating knob 65 such that the second cam surface 65 of the second actuating mechanism can be rotated in unison with the first operating knob 85 of the first operating mechanism. If the first operating knob 85, interconnected with the second operating knob 65, is rotated, the sixth switch element 10, switched by the second operating knob 65, is also switched. By the first operating knob 85 being rotated as it remains connected to the second operating knob 65, the sixth switch element 10, switched by the second operating knob 65, is also switched. Therefore, by the first operating knob 85 being rotated as it remains thrust, the second switch element 6 and the sixth switch element 10 have the operating states switched simultaneously thus enabling multifarious switch changeover operations.

If the first operating knob 85 is not thrust, with the guide protrusions 93, 94 not being engaged in the guide holes 97, the first operating knob 85 is rotatable through 360° about the supporting shaft 86 as center of rotation. If the first operating knob 85 is rotated, the plural interrupting pieces 90, provided on the switching actuator 88, intermittently interrupts the light emitted by the light-emitting elements 11*a*, 12*a* of the first and second photocouplers 11, 12 so as to be received by the light-receiving elements 11*b*, 12*b*. This interruption of light from the light-emitting elements 11*a*, 12*a* switches the detection state of the light-receiving elements 11*b*, 12*b*. The first and second photocouplers 11, 12 and the first operating knob 85 provided on the rotated first operating knob 85 make up a rotary encoder.

The first operating knob 85 is provided with a rotation limiting mechanism 98 for limiting free rotation of the first operating knob 85 and for realizing intermittent rotation of the first operating knob 85. Referring to FIGS. 2 and 10, the rotation limiting mechanism 98 has a gear portion 99 and plural steel balls 101. The gear portion 99 includes circumferentially extending recesses and ribs formed on the inner periphery of the ring-shaped member 96 mounted on the first operating knob 85. The steel balls 101 are arranged on the spring holder 81 as engagement elements. Two steel balls 101 as the engagement elements are provided and are mounted under the bias of a coil spring 102, as a biassing member, for appearing or disappearing from the outer peripheral surface of the spring holder 81 facing the gear portion 99 of the ring-shaped member 96. The steel balls 101, biassed by the coil spring 102 so as to be protruded to the outer periphery of the spring holder 81, are engaged with the gear portion 99 for limiting free rotation of the first operating knob 85.

If the first operating knob 85 is rotated, the steel balls 101, biassed by the coil spring 102, are engaged with or disengaged from the crests and valleys of the threads and recesses of the gear portion 99 for producing intermittent rotation of the first operating knob 85.

By the first operating knob 85 rotated intermittently, it becomes possible to easily control the detection output which is obtained on switching the first and second photocouplers 11, 12.

The rotation limiting mechanism 98, which enables rotation of the first operating knob 85, may be constructed so that the steel balls 101 and the gear portion 99 will be provided on the rotated first operating knob 85 and on the peripheral surface of the stationary spring holder 81.

By varying the size and the shape of the threads and recesses of the gear portion 99, the period of intermittent rotation of the first operating knob 85 can be changed for suitably setting the operating feeling during the rotation.

At a mid portion of the first operating knob 85 is mounted a third operating knob 105 adapted for leading out the light from the light source 13 provided on the switch element block 2 to the upper end face of the first operating knob 85 for switching the first switch element 5 and which is also adapted for changing over the first switch element 5. The third operating knob 105, formed of a synthetic resin, such as acrylic resin, having light transmitting properties, has a pushbutton portion 107 as one with an end of a shaft portion 106, as shown in FIG. 2. A cover plate 108 is mounted on the mid portion of the pushbutton portion 107. The cover plate 108 covers the light from the light source 13, led out to the mid portion of the pushbutton portion 107, so that only the portion around the pushbutton portion 107 is lit.

The third operating knob 105 is reciprocably mounted at the center of the first operating knob 85 by having the shaft portion 106 inserted into the supporting shaft 86. The distal end of the shaft portion 106 is protruded from the distal end of the supporting shaft 86 for facing the distal end of the light source 13. The distal end of the shaft portion 106 carries a thrusting element 110 adapted for thrusting the operating element 5*a* of the first switch element 5, as shown in FIG. 2. The thrusting element 110 is mounted so that a ring-shaped mounting piece 111, set upright on an upper lateral side, is fitted in the distal end of the shaft portion 106, for facing the first switch element 5 arranged laterally of the light source 13. A fitting hole 111*a* of the mounting piece 111 and the distal end of the shaft portion 106 are formed so as to have a D-shaped cross-section to prevent the thrusting element 110 from being rotated relative to the shaft portion 106.

The third operating knob 105 is biassed in a direction indicated by arrow E2 in FIG. 10, that is in a direction of being intruded into the first operating knob 85 by a coil spring 109 placed across the thrusting element 110 and the distal end of the supporting shaft 86. When the third operating knob 105 is mounted on the main casing member 1, the thrusting element 110 is caused to bear against the operating element 5*a* of the first switch element 5, at the same time as the third operating knob 105 is protruded from the first operating knob 85 in a direction indicated by arrow E1 in FIG. 10 against the force of the coil spring 109.

The coil spring 109 is selected so as to have a biassing force smaller than that of the spring member biassing the operating element 5*a*, so that, with the thrusting element 110 being pressed by the operating element 5*a* of the first switch element 5, the third operating knob 105 is protruded from the first operating knob 85.

Figure 15:
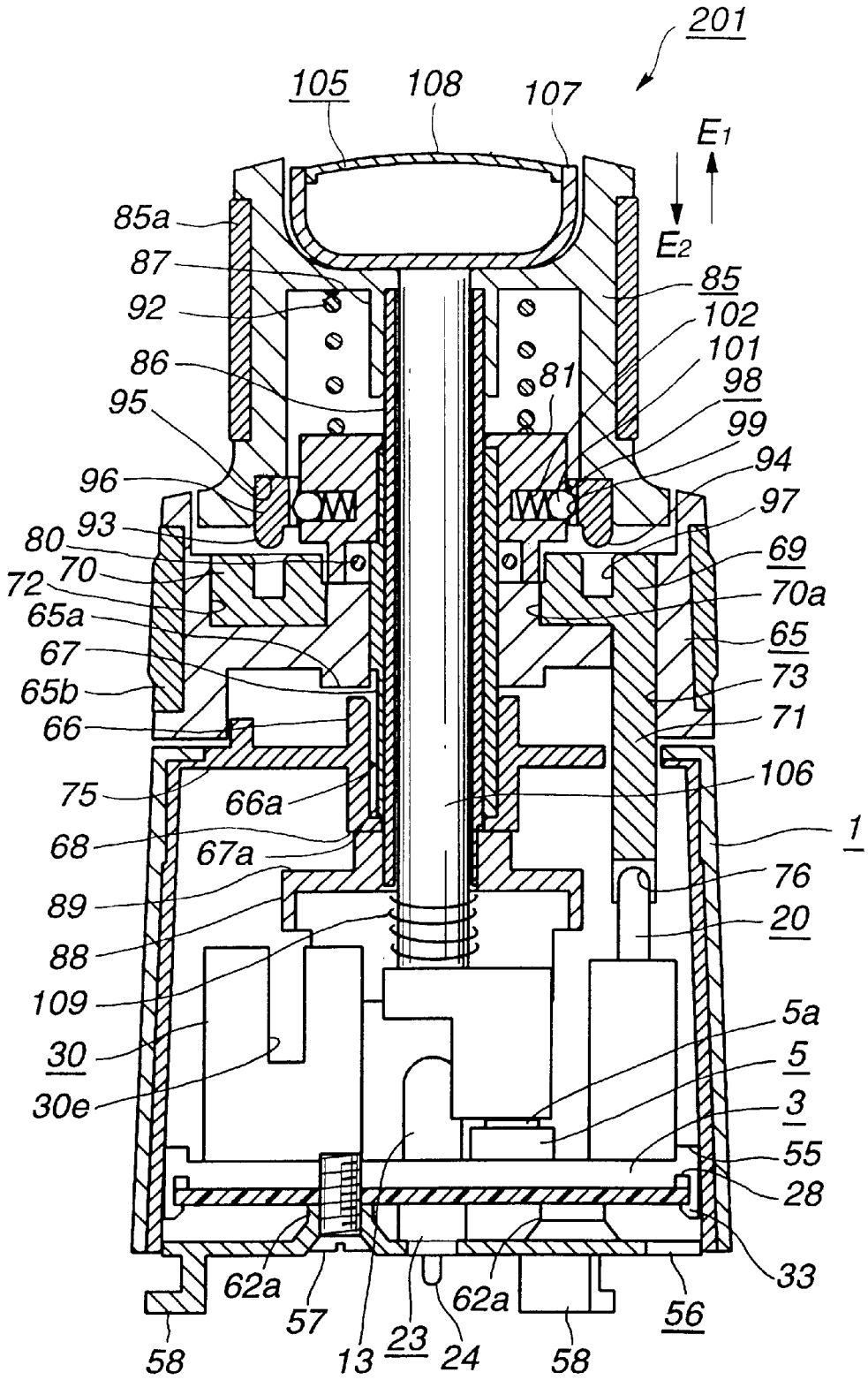
FIG. 15 is a cross-sectional view showing the state in which a first operating knob is thrust by a third operating knob.

If, after the operating element 5*a* of the first switch element 5 is thrust in the direction of arrow E1 in FIGS. 10 and 15, the thrusting state is annulled, the third operating knob 105 is moved in the direction of arrow E1 in FIG. 15, under the bias of the coil spring 111, so as to be reset to its initial position.

If the switch device 201 is actuated and the light source 13 is lit, the pushbutton portion 107 is lit by light from the light source 13 via the shaft portion 106 for displaying the operating state.

Referring to FIG. 6, there is set upright on the holder 3 of the switch element block 2 a rotation limiting piece 112 which supports a lateral side of the thrusting element 110 to limit rotation of the third operating knob 105 to cause the thrusting element 110 to reliably face the operating element 5*a* of the first switch element 5.

On a peripheral wall section 1*a* of the main casing member 1 are mounted first, second and third actuating buttons 113, 114 and 115 for switching between the third to fifth switch elements 7, 8 and 9 provided on the switch element block 2. Since the first, second and third actuating buttons 113, 114 and 115 are of the same construction, only the mounting state of the first actuating button 113 to the main casing member 1 is explained, while details of the second and third actuating buttons 113, 114 are omitted.

Figure 16:
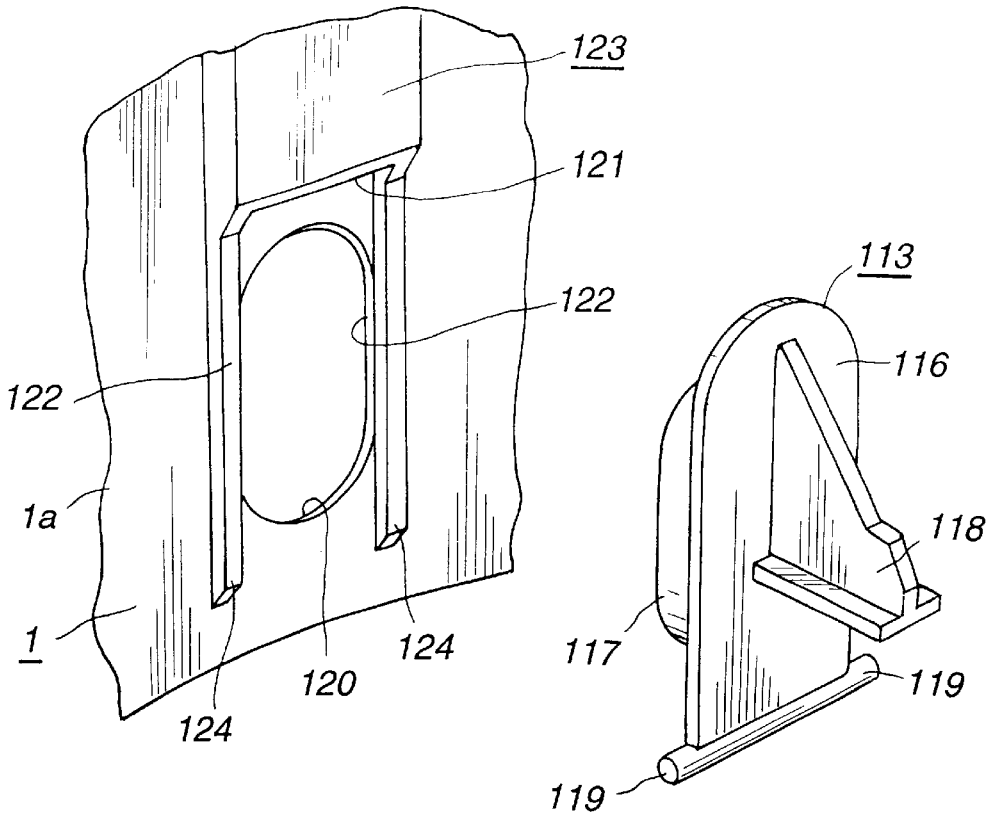
FIG. 16 is a perspective view showing the state in which a third switch element is mounted on the main body portion of the casing of the third operating button adapted for switching the third switch element.

Referring to FIGS. 2 and 16, an elliptically-shaped thrusting portion 117 is formed at a mid portion on the lateral surface of a supporting plate 116, while a thrusting piece 118 for thrusting an actuating element 7*a* of a third switch element 7 is set upright for extending in a direction normal to the supporting plate 116 on the opposite lateral surface of the supporting plate 116. On both sides of the proximal end of the supporting plate 116 are set upright a pair of supporting shafts 119, 119.

The peripheral wall section 1*a* of the main casing member 1 is formed with an opening 120 for allowing the thrusting portion 117 to be protruded to outside, while the inner rim of the opening 120 is formed with an operating button holder 123 having an inserting recess 121 in which the distal end of the supporting plate 116 is inserted and supported and the operating button holder 123 having engagement grooves 122, 122 engaged with both ends of the supporting plate 116. On the distal end of the operating button holder 123 is formed a reentrant shaft supporting portion 124 engaged by a pair of supporting shafts 119, 119 provided on the distal end of the supporting plate 116. The inserting recess 121 and the engagement grooves 122, 122 are formed with a width larger than the thickness of the supporting plate 116.

Figure 17:
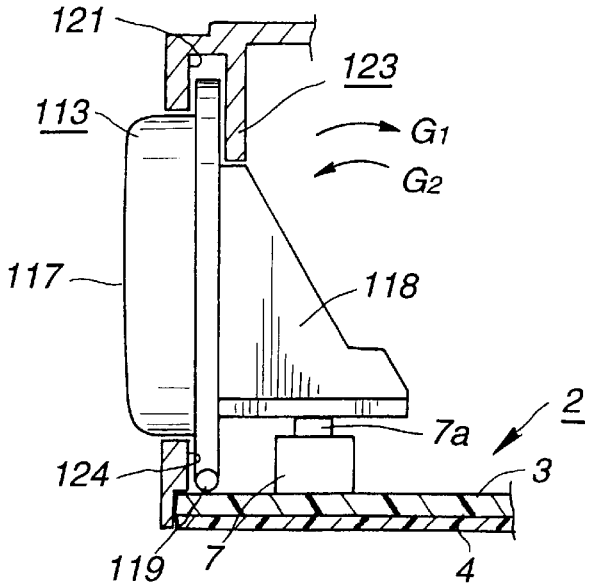
FIG. 17 is a cross-sectional view showing the mounting state of the third operating button on the main body portion of the casing.

The first operating button 113 is mounted on the inner peripheral surface of the main casing member 1 by fitting the thrusting portion 117 in the opening 120 so that the thrusting portion 117 will be protruded from the main casing member 1, with the distal end of the supporting plate 116 being introduced into the inserting recess 121, and by engaging both sides of the supporting plate 116 in the engagement grooves 122, 122, with the supporting shafts 119, 119 engaging with shaft supporting portions 124. The first operating button 113 is mounted in position without the risk of detachment from the main casing member 1, by the supporting shafts 119, 119 engaged in the shaft supporting portions 124, 124 being supported by the holder 3 of the switch element block 2 mounted on the bottom surface of the main casing member 1. The first, second and third actuating buttons 113, 114 and 115, mounted on the main casing member 1, is supported for movement in the directions of arrows G1 and G2 in FIG. 17 in a range of the gap defined between the supporting plate 116, inserting recess 121 and the engagement grooves 122, 122, with the supporting shafts 119, 119 as center.

When the first operating button 113 is mounted on the main casing member 1, the thrusting piece 118 is caused to bear against the actuating element 7*a* of the third switch element 7 and is rotationally biassed by the spring member biassing the actuating element 7*a* into pressure contact with the inner surface of the peripheral wall section 1*a* of the main casing member 1. The thrusting portion 117 is protruded via the opening 120 outwardly form the main casing member 1. If the thrusting portion 117 is thrust such that the first operating button 113 is rotated about the supporting shafts 119, 119 in a direction indicated by arrow G1 in FIG. 17, the actuating element 7*a* is thrust by the thrusting piece 118 into contact with the contact against the bias of the spring member to effect switching of the third switch element 7. If the thrusting state is annulled, the first operating button 113 is rotated in the direction of arrow G2 in FIG. 17, under the bias of the spring member biassing the actuating element 7*a*, such that the thrusting portion 117 is reset to its initial operating state in which it is protruded outwardly of the main casing member 1.

The second and third actuating buttons 114, 115 perform similar operations and hence the detailed description is omitted for simplicity.

In the switch device 201 of the present invention, as described above, the switching of the first to sixth switch elements 5 to 10 and the first and second photocouplers 11, 12 is effected by suitable actuation of the first to third operating knobs 85, 65 and 105 and of the first to third actuating buttons 113 to 115.

The above-described switch device 201 is mounted on the base block 21 via a mounting plate 56 mounted on the bottom surface of the main casing member 1. The base block 21, mounted on a stationary portion, such as a dashboard or a wall surface of a vehicle or on an outer peripheral surface of the casing of the electronic equipment, has a subsequently disc-shaped main body portion of the base block 131. On the outer periphery of a supporting substrate 132 is mounted an upstanding peripheral wall section 135 the distal end face and the proximal end surface of which are a setting surface 133 of the switch device 201 and the setting surface to a stationary portion. By the provision of the peripheral wall section 135, a first housing recess 136 and a second housing recess 137 are formed on the surface of the main body portion of the base block 131 for setting the switch device 201 and on the surface of the main body portion of the base block 131 for setting on the stationary portion.

Figure 18:
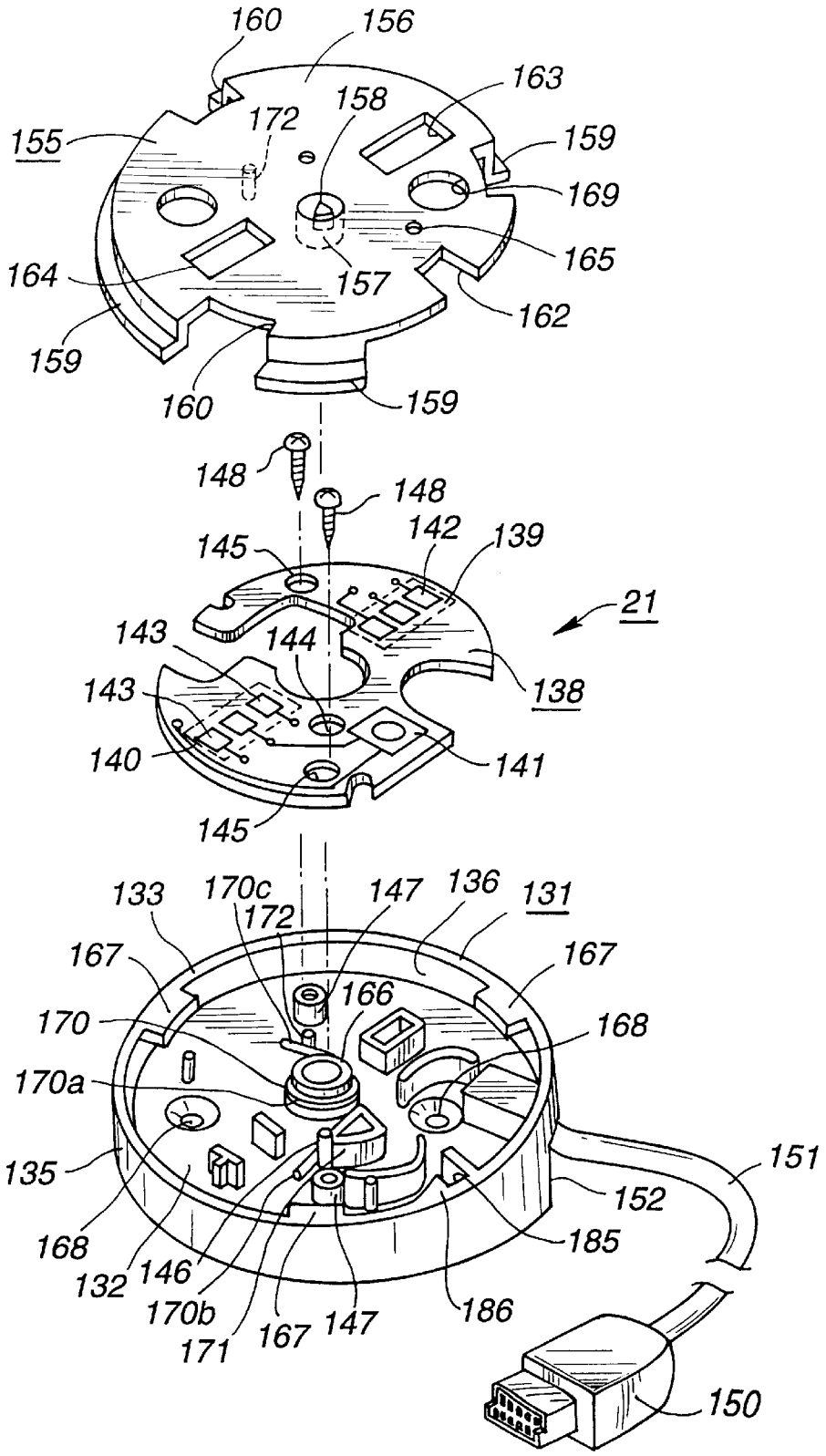
FIG. 18 is an exploded perspective view showing a base block adapted for mounting the switch device.

Within the first housing recess 136 is mounted a printed circuit board 138 on which there are mounted first and second connection terminals 139, 140 and a control switch element 141, as shown in FIG. 18. The first and second connection terminals 139, 140 are provided on the bottom surface of the switch device 201 and are electrically connected to the first and second connectors 22, 23. The control switch element 141 is a switch element connected to the base block 21 and which is adapted for switching the electronic equipment controlled by the switch device 201 to its initial state. The first and second connection terminals 139, 140 are provided with plural connection terminals 142, 143 contacted with the contact pins 24 of the first and second connectors 22, 23.

In the printed circuit board 138 are formed a positioning hole 144 and plural screw inserting holes 145. The printed circuit board 138 is arranged in the first housing recess 136 by having a positioning boss 146 set on the main body portion of the base block 131 engaged in the positioning hole 144 so that the printed circuit board 138 is set on the plural supporting bosses 147 set on the main body portion of the base block 131. The printed circuit board 138 is secured in position by a set screw 148 inserted into screw inserting holes 145 into threaded engagement with the supporting bosses 147 in such a manner that the printed circuit board 138 is mounted in position on the base block 21.

Figure 19:
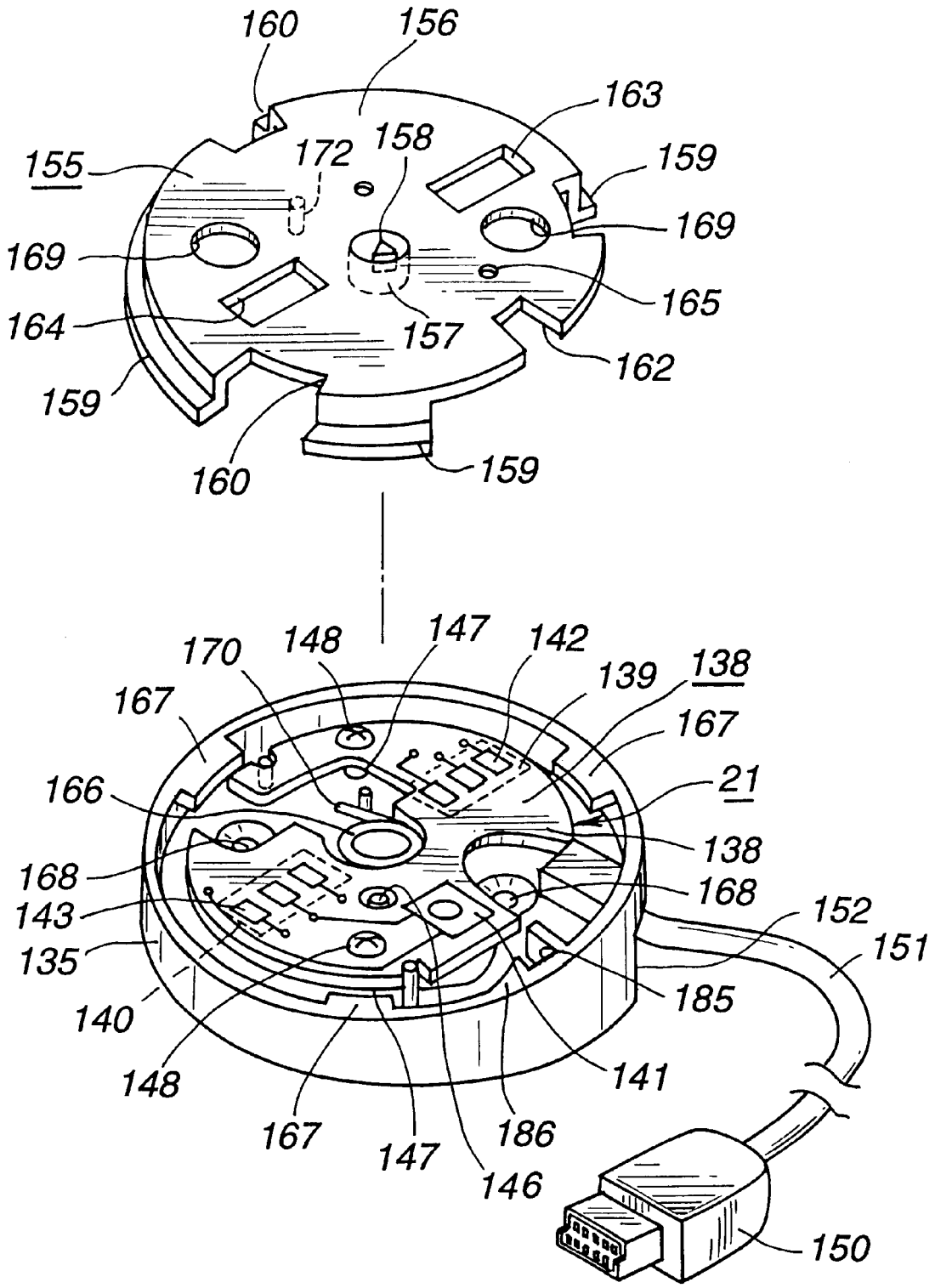
FIG. 19 is a perspective view showing the mounting state of the printed circuit board on the main body portion of the base block.

To the printed circuit board 138 is connected a connection cord 151 having mounted on its distal end a connector 150 used for connecting to the electronic equipment the switch device 201 mounted on the base block 21. Referring to FIG. 19, the connection cord 151 is electrically connected via a wiring pattern provided on the printed circuit board 138 to the first and second connection terminals 139, 140 and the control switch element 141 and is passed through a through-hole 152 formed for extending from the supporting substrate 132 to the upstanding peripheral wall section 135 so as to be led outwardly of the main body portion of the base block 131.

On the main body portion of the base block 131 is mounted a shutter member 155 adapted for opening/closing the first and second connection terminals 139, 140 of the printed circuit board 138 arranged in the first recess 13 6 in association with loading/unloading of the switch device 201. Referring to FIGS. 18 and 19, the shutter member 155 is substantially disc-shaped and is sized to be large enough to be engaged in the first housing recess 136, as shown in FIGS. 18 and 19. The shutter member 155 is provided with a cylindrically-shaped upstanding supporting shaft 157 at a mid portion on the lower surface of the major surface section 156. The supporting shaft 157 is engaged by the engagement pin 59 provided on the switch device 201. On the inner rim of the supporting shaft 157 is protuberantly formed an engagement boss 158 engaged in an engagement groove 60 formed in the engagement pin 59 when the engagement pin 59 is with the supporting shaft 157 for controlling the mounting direction of the switch device 201.

On the outer rim portion of the major surface 156 of the shutter member 155 are formed plural engagement pawls 159 of an L-shaped cross-section for depending from the outer rim portion. The major surface 156 is formed with plural insertion engagement portions 160 and a lock engagement recess 162. The insertion engagement portions 160, arranged between the engagement pawls 159, make up second engagement means adapted for engagement with engagement pawls 58 provided on the switch device 201. The lock engagement recess 162 is engaged by the lock member 161 mounted on the main casing member 1 of the switch device 201. The insertion engagement portions 160 and the engagement recess 162 are formed by cutting out the rim of the major surface 156 in the form of recesses. The major surface 156 is formed with first and second openings 163, 164 and a jig inserting opening 165 for insertion of a jig adapted for actuating a control switch 141. The first and second openings 163, 164 are adapted for exposing to outside the first and second connection terminals 139, 140 provided on the printed circuit board 138 arranged in the first housing recess 136.

The major surface 156 also has a through-hole 169 for exposing to outside a screw through-hole 168 passed through by a set screw for securing the base block 21 to the stationary portion and which is bored in the supporting substrate 132 of the main body portion of the base block 131.

The above-described shutter member 155 is supported on the main body portion of the base block 131 for rotation about the supporting shaft 157 by having the supporting shaft 157 fitted on a tubular fitting lug 166 formed at a mid portion of the supporting substrate 132. When the shutter member 155 is supported, the engagement pawls 159 are engaged with the plural engagement pieces 167 formed for extending towards the distal end of the upstanding peripheral wall section 135 in the direction of the first housing recess 136 for mounting the shutter member 155 without the risk of accidental detachment thereof from the main body portion of the base block 131.

When the switch device 201 is mounted in position, the engagement pieces 167 provided as engagement means on the main body portion of the base block 131 are engaged with mating engagement pawls 58 as mating engagement means provided on the switch device 201.

Figure 20:
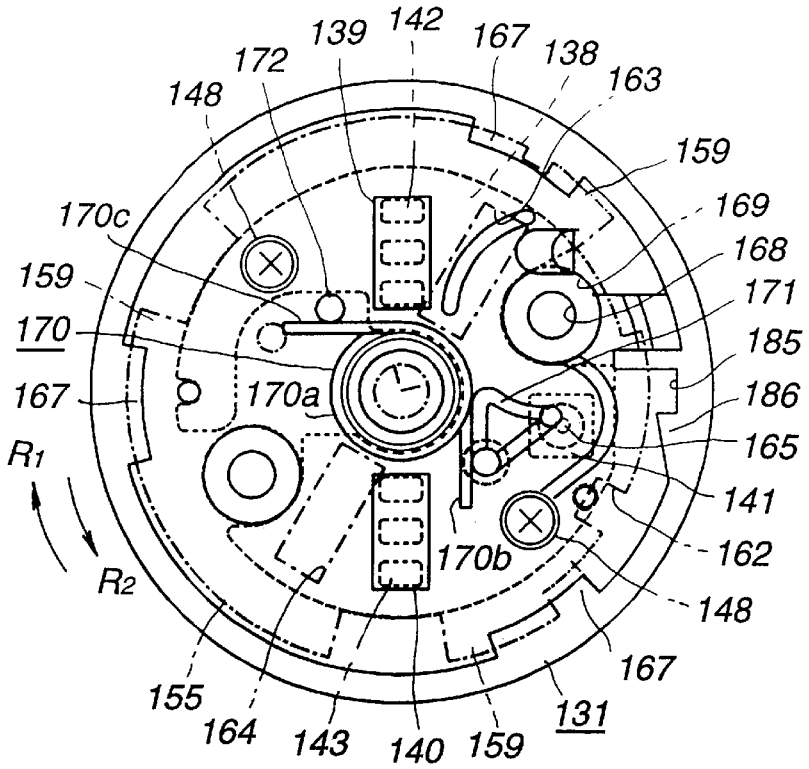
FIG. 20 is a plan view showing the state in which a shutter member mounted on a main body portion of the base is biassed to a first position by a torsion coil spring.
Figure 21:
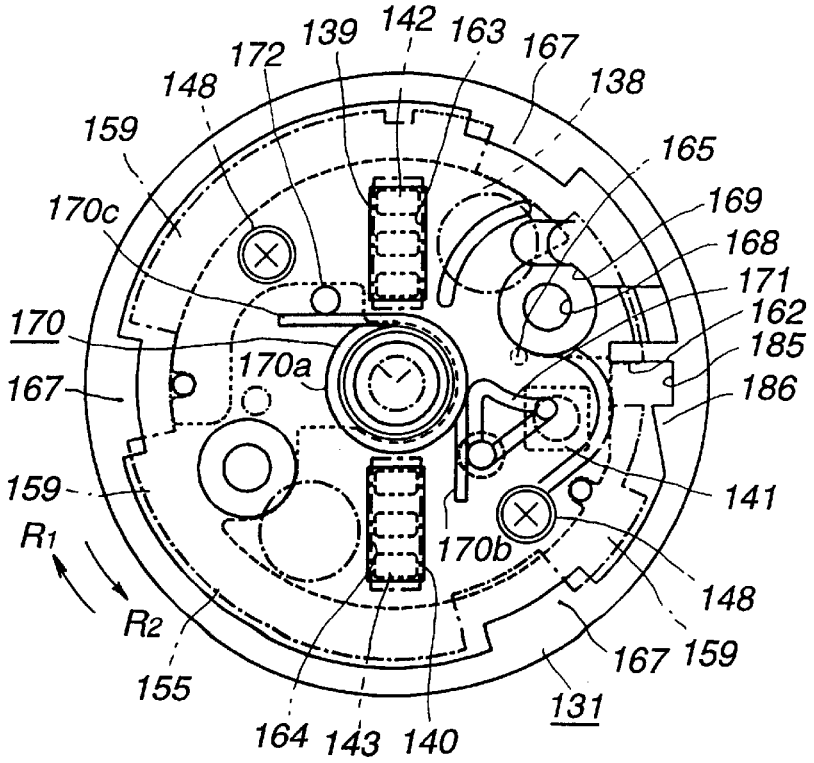
FIG. 21 is a plan view showing the state in which a shutter member mounted on the main body portion of the base block.

The shutter member 155, mounted on the main body portion of the base block 131, is rotationally biassed in a direction indicated by arrow R1 in FIG. 20 by a torsion coil spring 170 which is a rotational biassing member provided on the main body portion of the base block 131. The torsion coil spring 170 rotationally biases the shutter member 155 in a direction indicated by arrow R1 in FIG. 20 by having its coil part 170*a* placed around the fitting protrusion 166, by having its arm 170*b* retained by a first spring retainer 171 set upright on the supporting substrate 132 and arranged in a housing spacing, defined between the printed circuit board 138 and the supporting substrate 132, and by having its opposite side arm 170*c* retained by a spring retention pin 172 protruded from the major surface 156 of the shutter member 155. The torsion coil spring 170 is mounted on the main body portion of the base block 131 by having its arm 170 retained by the first spring retainer 171 and by having its opposite side arm 170*c* retained by the second spring retainer 173 set upright on the supporting substrate 132. Thus, the torsion coil spring 170 is controlled in its biassing position in the opening direction of the arms 170*b*, 170*c* for controlling the rotational biassing position of the shutter member 155.

When the switch device 201 is not mounted on the base block 21, the shutter member 155 is rotated under the bias of the torsion coil spring 170 in a direction of arrow R1 of FIG. 20 so as to be placed in the first position of closing the first and second connection terminals 139, 140. Since the first and second connection terminals 139, 140 are covered by the shutter member 155 when the switch device 201 is not mounted in position, there is no risk of the connection terminals 139, 140 inadvertently contacting with foreign matter to prevent the malfunctions of the electronic equipment connected to the switch device 201.

When the shutter member 155 is at the first position, as shown in FIG. 20, a jig insertion opening 165 faces the control switch element 141 so that the jig is inserted via the jig insertion opening 165 into the main body portion of the base block 131 to enable the operation of the control switch element 141.

Since the control switch element 141 is positioned in the first housing recess 136 covered by the shutter member 155, there is no risk of inadvertent operations.

When the shutter member 155 is in the first position, the through-hole 169 faces a screw-inserting hole 168. Thus, a set screw can be inserted into the screw-inserting hole 168 via the through-hole 169 for mounting the base block 21 to the stationary portion.

Turning to the shutter member 155, when the switch device 201 is mounted on the base block 21, the mating engagement pawls 58 are engaged with the insertion engagement portions 160 operating as engagement means and the lock member 161 is engaged with the lock engagement recess 162. In this state, the switch device 201 is rotated against the force of the torsion coil spring 170 in a direction indicated by arrow R2 in FIG. 20 to the second position in which the first and second openings 163, 164 face the first and second connection terminals 139, 140. At this time, the contact pins 24 of the first and second connectors 22, 23 provided on the switch device 201 are intruded into the base block 21 via the first and second openings 163, 164 into contact with the connection terminals 142, 143 of the first and second connection terminals 139, 140.

Figure 22:
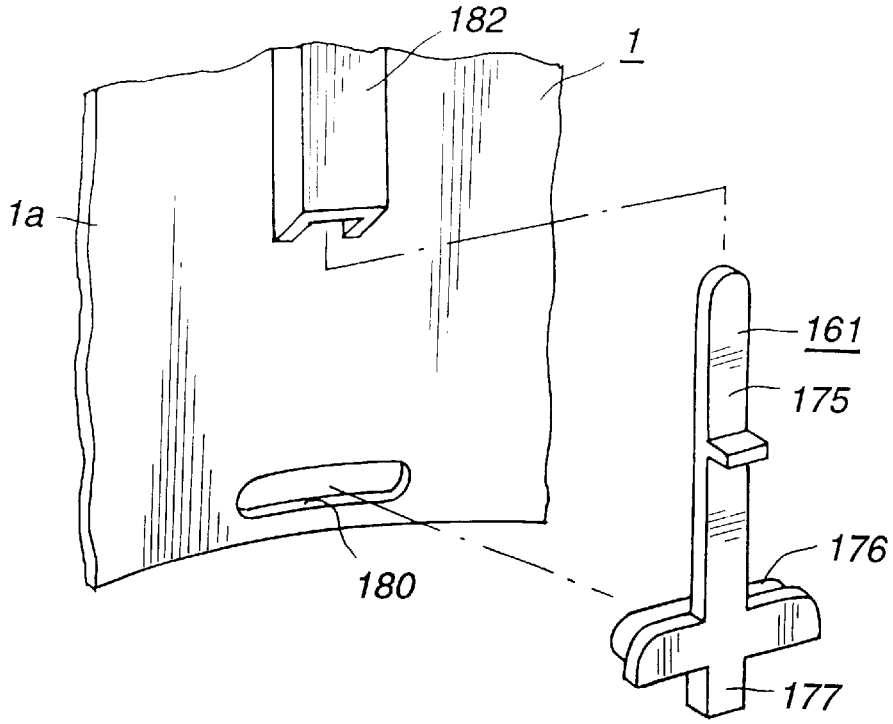
FIG. 22 is a perspective view showing the mounting state of a lock member on the main body portion of the casing.

The lock member 161 for locking the switch device 201 carried on the base block 21 is mounted on the inner lateral surface of the peripheral wall section 1*a* of the main casing member 1, as shown in FIGS. 2 and 22. An elliptically-shaped thrusting portion 176 is provided on the proximal end of an elastic displacement piece 175 operating as a mounting portion for the main casing member 1. The proximal end of the elastic displacement piece 175 is formed with an upstanding engagement protrusion 177. Partway on the elastic displacement piece 175 is protuberantly formed a supporting protrusion 179 abutted against a supporting piece 178 provided on the holder 3 of the switch element block 2 and which operates as a supporting point of the elastically displaced elastic displacement piece 175.

The peripheral wall section 1*a* has an opening 180 for protruding the thrusting portion 176 to outside and has on its inner surface a fitting portion 118*l* on which is fitted the distal end of the elastic displacement piece 175.

Figure 23:
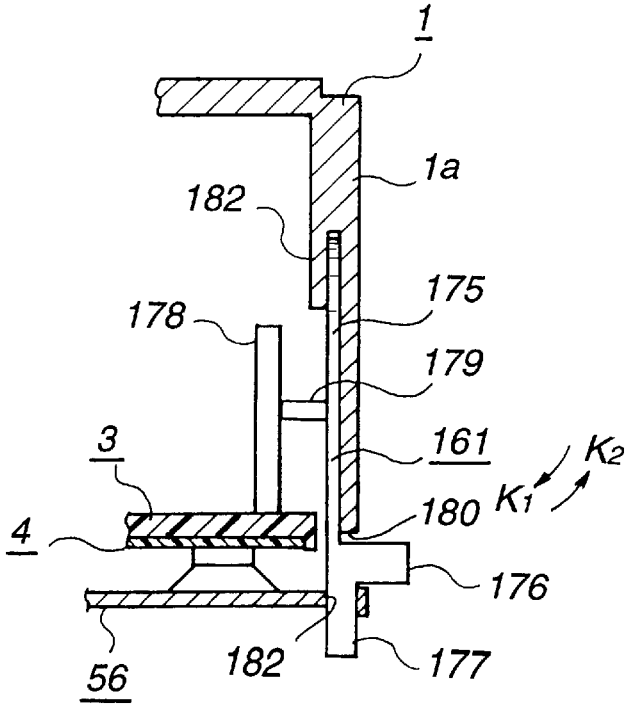
FIG. 23 is another perspective view showing the mounting state of a lock member on the main body portion of the casing.

The lock member 161, mounted on the main casing member 1, is elastically displaced in a direction indicated by arrow K1 in FIG. 23, about a supporting protrusion 179 as the center of rotation. When the thrusting operation ceases, the lock member is resiliently restored in the direction indicated by arrow K2 in FIG. 23 so that the thrusting portion 17 is protruded outwardly from the main casing member 1.

For mounting on the base block 21 the mounting plate 56 carrying the mating engagement pawls 58 on the bottom side of the main casing member 1, for protruding the engagement protrusion 177 of the lock member 161, the mating engagement pawls 58 are engaged with the insertion engagement portions 160 provided on the shutter member 155. The engagement protrusion 177 is engaged in the lock engagement recess 162 formed in the shutter member 155, with the bottom surface of the main casing member 1 being then set on the main body portion of the base block 131. At this time, the contact pins 24 of the first and second connectors 22, 23 provided on the switch device 201 are engaged with first and second openings 163, 164 provided in the shutter member 155.

Figure 24:
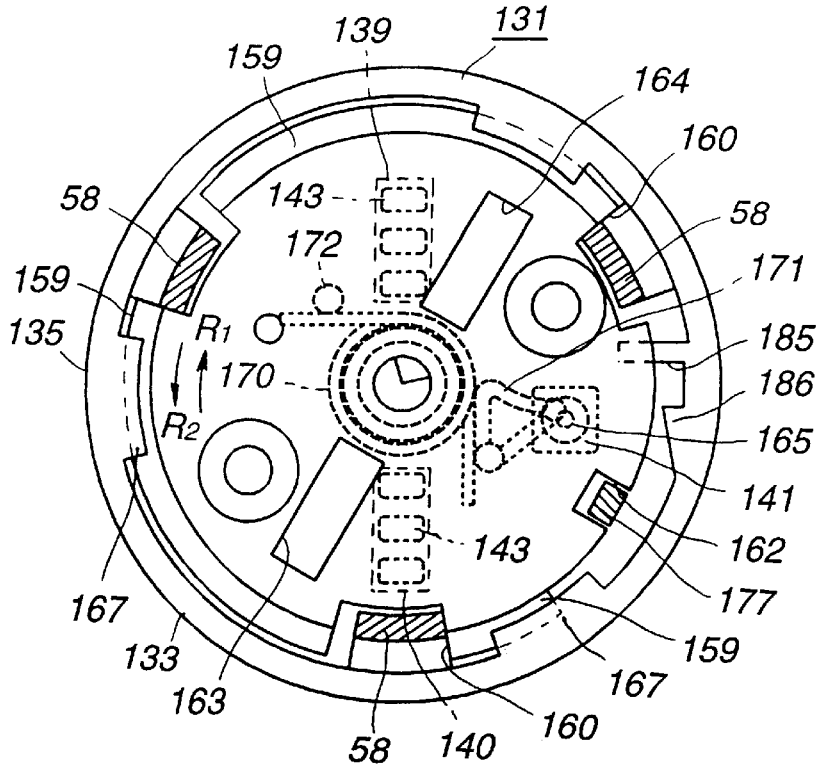
FIG. 24 is a plan view showing the state of mounting of the switch device on the base block.

If the switch device 201 is rotated in the direction of arrow R2 in FIG. 24, the shutter member 155 is rotated in the direction of arrow R2 in FIG. 24, in unison with the switch device 201, as the opposite side arm 170*c* of the torsion coil spring 170 is elastically displaced by the spring retention pin 172. If the switch device 201 is rotated further in the direction indicated by arrow R2 in FIG. 24, the engagement protrusion 177 of the lock member 161 rides on an engagement guide section 186 provided on the inner rim side of the upstanding peripheral wall section 135 of the main body portion of the base block 131, as shown in FIG. 18.

The engagement guide section 186 operates for guiding the engagement protrusion 177 of the lock member 161 so that the engagement protrusion 177 will be smoothly engaged with the recessed lock portion 185 formed in the inner rim of the upstanding peripheral wall section 135. The surface of the engagement guide section 186 in sliding contact with the engagement protrusion 177 is formed as an inclined surface with respect to the direction of movement of the engagement protrusion 177.

When the engagement protrusion 177 rides on the engagement guide section 186, the lock member 161 is elastically displaced in a direction indicated by arrow K2 in FIG. 23. If the switch device 201 is further rotated in the direction indicated by arrow R2 in FIG. 24, the engagement protrusion 177 rides on the engagement guide section 186 for restoring the elastic displacement piece 175 in the direction indicated by arrow K1 in FIG. 23 for engaging the engagement protrusion 177 with the lock portion 185.

Figure 25:
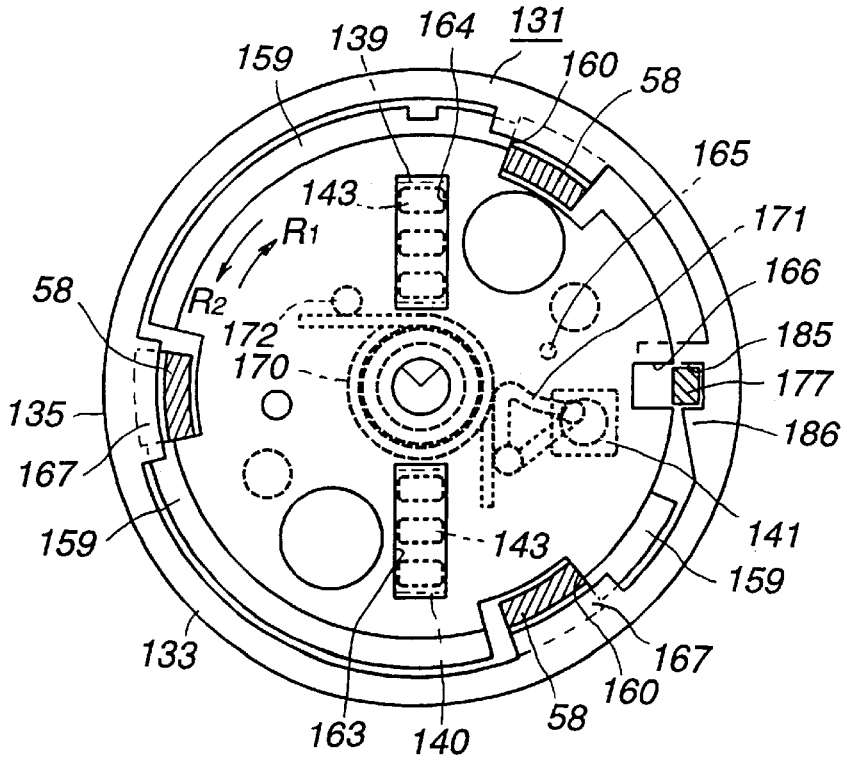
FIG. 25 is another plan view showing the state of mounting of the switch device on the base block.

Since the engagement protrusion 177 of the lock member 161 is engaged with the lock portion 185 and mounted in this state on the base block 21, as shown in FIG. 25, the mating engagement pawls 58 are positively kept engaged with the engagement pieces 167 for preventing the switch device 201 from becoming readily detached from the base block 21.

If the switch device 201 is rotated in the direction of arrow R2 in FIG. 24 until the engagement protrusion 177 of the lock member 161 is engaged with the lock portion 186, the shutter member 155 also is rotated in the same direction in unison with the switch device 201 to reach the second position in which the first and second openings 163, 164 face the first and second connection terminals 139, 140. The connector pins 24 of the first and second connectors 22, 23 provided on the switch device 201 are protruded via the first and second openings 163, 164 into the inside of the base block 21 into contact with the connection terminals 142, 143 of the first and second connection terminals 139, 140, as shown in FIG. 25.

For dismounting the switch device 201 mounted on the base block 21, the supporting piece 178 is thrust for elastically displacing the lock member 161 in the direction indicated by arrow K1 in FIG. 13 for disengaging the engagement protrusion 177 from the lock portion 185. This causes the switch device 201 mounted on the base block 21 to be turned in the direction indicated by arrow R1 in FIG. 24 to disengage the mating engagement pawls 58 from the engagement pieces 167 to permit dismounting of the switch device 201. When the switch device 201 is detached in this manner from the base block 21, the shutter member 155 is rotated in the direction of arrow R1 in FIG. 25, under the bias of the torsion coil spring 170, to the first position of closing the first and second connection terminals 139, 140, as shown in FIG. 20.

Figure 26:
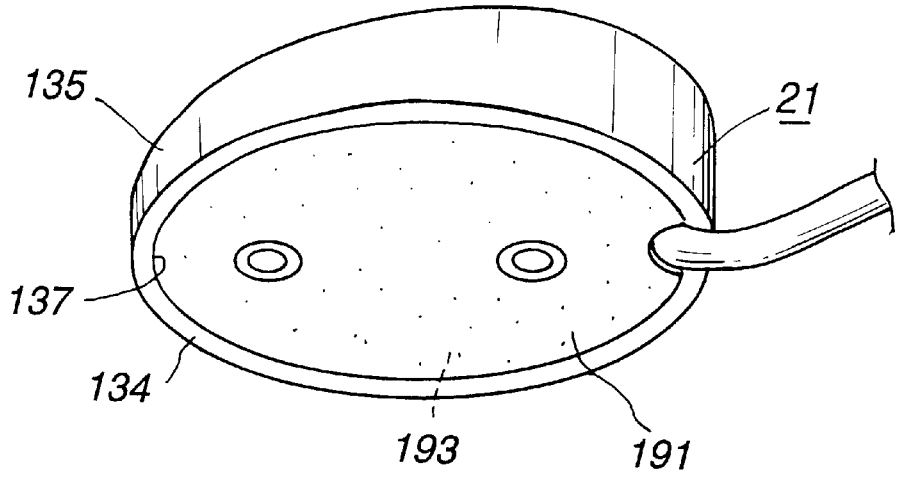
FIG. 26 is a perspective view showing the bottom side of the base block.
Figure 27:
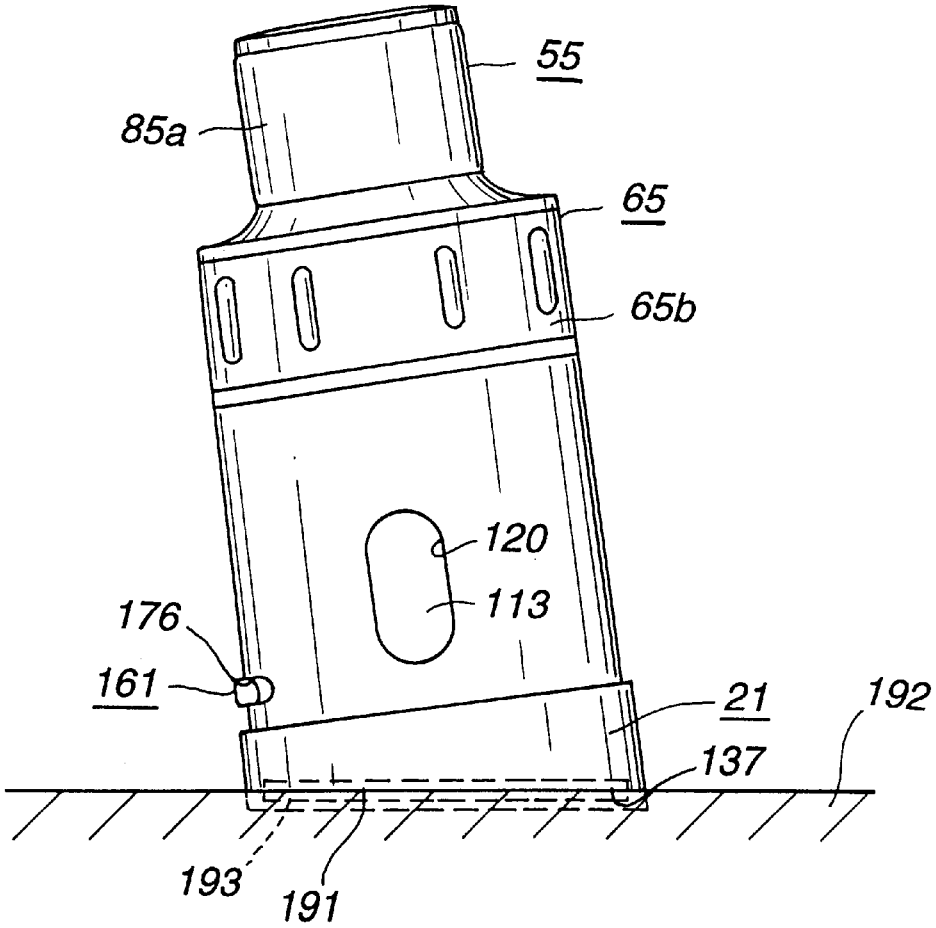
FIG. 27 is a side view showing the mounting state of the switch device on the base block.

Within the second housing recess 137, formed in the mounting surface of the base block 21 to the stationary portion, an elastic member 191 of, for example, urethane, is bonded in position by an adhesive, as shown in FIG. 26. This elastic member 191 protects the back surface of a stationary portion 192, such as a dashboard, when the base block 21 is mounted on the stationary portion 192, as shown in FIG. 27. When the base block 21 is secured to the stationary portion 192 using a set screw, the elastic member 191 operates as a shock-absorbing member for preventing the loosening of the set screw such as by vibrations.

The surface of the elastic member 191 is coated with an adhesive 193 for permitting the mounting of the base block 21 to the stationary portion 192 by adhesion.

The setting surface side of the switch device 201 on the base block 21 is inclined at an angle relative to the mounting surface. The reason the setting surface of the switch device 201 on the base block 21 at an angle relative to the mounting surface is that, when the switch device 201 is mounted on the base block 21 secured to the stationary portion 192, such as a dashboard, the switch device 201 will directly face the operator, such as a vehicle driver.

What is claimed is:

1. A switch device comprising:

a main body portion of the switching device having a switch element and switching means for switching said switch element;

a base block on which is removably mounted said main body portion of the switching device, said base block including a connection terminal portion electrically connected to a connecting portion provided on said main body portion of the switching device; and a shutter member mounted on said base block for movement between a first position of covering said connection terminal portion and a second position of opening said connection terminal portion, said connection terminal portion being electrically controlled by switching the switching means through the connecting portion, said shutter member being moved in association with the operation of loading/unloading of said main body portion of the switching device on or from said base block.

2. The switch device as claimed in claim 1 wherein said shutter member is mounted on said base block under bias of biassing means towards a first position of covering said connection terminal portion, said shutter member having second engagement means engaging with mating engagement means engaged with first engagement means provided on said base block when said main body portion of the switching device is mounted on said base block; said shutter member when the main body portion of the switching device is mounted on said base block being moved by said mating engagement means engaged with second engagement means against the bias of said biassing means toward the second position of opening said connection terminal portion for electrically connecting said connection portion with said connection terminal portion.

3. The switch device as claimed in claim 1 wherein said shutter member is rotatably supported by said base block and is rotated in association with the loading/unloading of said main body portion of the switching device for opening/closing said connection terminal portion.

4. The switch device as claimed in claim 1 wherein said base block carries a switch element exposed to outside when said shutter member is at the first position of covering said connection terminal portion.

5. The switch device as claimed in claim 1 further comprising:

limiting means between said main body portion of the switching device and said shutter member, said limiting means limiting a position of engagement between said main body portion of the switching device and said shutter member.

6. The switch device as claimed in claim 1 further comprising:

lock means for limiting the engagement/disengagement between said main body portion of the switching device and said base block when said mating engagement means provided in said main body portion of the switching device is engaged with first engagement means provided on said base block.

7. The switch device as claimed in claim 1 wherein at least one connection portion is provided in said main body portion of the switching device and wherein said base block carries a connection terminal portion electrically connected to said connection portion.

8. The switch device as claimed in claim 1 wherein said shutter member has an opening for exposing said connection terminal portion.

* * * * *